US010060124B2

(12) United States Patent
Rodenburgh et al.

(10) Patent No.: US 10,060,124 B2
(45) Date of Patent: Aug. 28, 2018

(54) CONSTRUCTION SYSTEM HAVING CORNER CORE BLOCKS AND DECORATIVE FACE BLOCKS

(71) Applicant: HENGESTONE HOLDINGS, INC., Toronto (CA)

(72) Inventors: Ray Rodenburgh, Toronto (CA); Aaron Bailey, Toronto (CA)

(73) Assignee: HENGESTONE HOLDINGS, INC., Toronto (CA)

( * ) Notice: Subject to any disclaimer, the term of this patent is extended or adjusted under 35 U.S.C. 154(b) by 0 days.

(21) Appl. No.: 15/597,301

(22) Filed: May 17, 2017

(65) Prior Publication Data

US 2018/0209143 A1 Jul. 26, 2018

Related U.S. Application Data

(60) Provisional application No. 62/449,636, filed on Jan. 24, 2017.

(51) Int. Cl.
*E04B 2/08* (2006.01)
*E04F 13/08* (2006.01)
(Continued)

(52) U.S. Cl.
CPC ..... *E04B 2/08* (2013.01); *E04F 13/0835* (2013.01); *E04F 13/141* (2013.01);
(Continued)

(58) Field of Classification Search
CPC ..... E04C 1/395; E04C 1/397; E02D 29/025; E02D 17/205; E04B 1/043; E04B 2/02;
(Continued)

(56) References Cited

U.S. PATENT DOCUMENTS 658,869 A 10/1900 Rosenbaum
D833,736 10/1906 Fenn
(Continued)

FOREIGN PATENT DOCUMENTS

CA 2244348 5/1999
CA 2547415 11/2007
EP 1862597 B1 12/2007

OTHER PUBLICATIONS

PCT International Search Report and Written Opinion dated Apr. 16, 2018 re: International Patent Application No. PCT/CA2018/000014.

*Primary Examiner* — Robert Canfield
*Assistant Examiner* — Matthew J Gitlin
(74) *Attorney, Agent, or Firm* — Norton Rose Fulbright Canada LLP; Paul J. Field

(57) ABSTRACT

A construction system using core blocks having a horizontal front mounting recess in the front surface defining a core detent lip, and face blocks having a horizontal rear mounting recess defining a face detent lip, and connectors for supporting stacked courses of the face blocks suspended on the front surfaces of stacked courses of core blocks, the connectors having a rear hook and a front hook, wherein the face blocks are each supported by their rear surfaces with at least one connector, by engagement of the front hook with the face detent lip and engagement of the rear hook with the core detent lip.

10 Claims, 32 Drawing Sheets

(51) Int. Cl.
*E04F 13/14* (2006.01)
*E04B 2/02* (2006.01)
*E02D 17/20* (2006.01)

(52) U.S. Cl.
CPC .... *E02D 17/205* (2013.01); *E04B 2002/0208* (2013.01); *E04B 2002/0228* (2013.01); *E04B 2002/0243* (2013.01); *E04B 2103/02* (2013.01)

(58) Field of Classification Search
CPC ..... E04B 2/08; E04B 2/16; E04B 2/18; E04B 2/32; E04B 2/40; E04B 2002/0206; E04B 2002/021; E04B 2002/0208; E04B 2002/0228; E04B 2002/0234; E04B 2002/0236; E04B 2002/0243; E04B 2103/02; E04F 13/141; E04F 13/0835; E01F 8/0005
USPC ..... 52/597, 598, 603, 604, 605, 606, 612, 52/285.1, 285.3
See application file for complete search history.

(56) References Cited

U.S. PATENT DOCUMENTS 1,707,347 A 4/1929 Dunbar
1,946,125 A 2/1934 Bennett
1,805,334 A 5/1934 Kelly
2,066,268 A 12/1936 Hohner
2,392,551 A 1/1946 Roe
4,478,021 A * 10/1984 Person ..... B28B 15/00 52/309.7
4,803,821 A 2/1989 Funaki
4,856,246 A 8/1989 Shimasaki
4,860,505 A 8/1989 Bender
4,890,433 A 1/1990 Funaki
4,916,875 A 4/1990 Kashiwagi
5,029,425 A 7/1991 Bogataj
5,816,749 A 10/1998 Bailey, II
5,930,964 A 8/1999 Boehning
6,000,183 A 12/1999 Newman
6,164,029 A 12/2000 Lee
6,178,715 B1 1/2001 Pacitto et al.
6,289,647 B1 9/2001 Sjolander
6,758,636 B2 7/2004 Rainey et al.
RE39,922 E 11/2007 Rainey
7,617,646 B2 11/2009 Losse
D621,075 S 8/2010 Haeussler
8,882,398 B2 11/2014 Bender et al.
9,453,341 B1 9/2016 Swierad et al.
2007/0166112 A1 7/2007 Risi
2007/0292216 A1 12/2007 Hamel
2008/0134615 A1 6/2008 Risi et al.
2010/0018146 A1* 1/2010 Aube ..... E02D 29/0233 52/483.1
2011/0072753 A1 3/2011 MacDonald
2011/0203212 A1 8/2011 Matys et al.

* cited by examiner

CONSTRUCTION SYSTEM HAVING CORNER CORE BLOCKS AND DECORATIVE FACE BLOCKS

TECHNICAL FIELD

The invention relates to construction system having a supporting core built of corner (quoin) core blocks and optional mid-course core blocks faced with an exterior veneer of decorative face blocks mounted on the core blocks.

BACKGROUND OF THE ART

Outdoor walls and stairs are often constructed of modular blocks laid in predominantly straight lines joined at right angled corners. Corners are highly visible and modular block systems preferably provide visually appealing corner details that do not rely on the skill of the builder.

To construct wall and stairs to match or complement adjacent pavement blocks or pavers, the applicants have previously created a system that has supporting core blocks faced with an exterior veneer of decorative face blocks mounted on the core blocks, described in international patent application PCT/CA2016/000211 and first published as U.S. Pat. No. 9,453,341. The exposed face blocks have horizontal grooves in a rear surface that is not visible in the finished wall. The core blocks have horizontal supporting ridges on which the face blocks are hung by interlocking the grooves and ridges.

Use of separate face blocks mounted on core blocks has several advantages as more fully described in PCT/CA2016/000211. The use of slip molding ensures dimensional conformity and the finished wall structure assembled from the blocks complies with accurate reproducible dimensional requirements. Core blocks are not visible in the finished structures and can be mass produced from standard concrete mixes at low cost without concern for visual appeal. The unique appearance of the structure is achieved using thinner face blocks to cover the core blocks. Face blocks can be manufactured using the same materials, processes, colours, surface treatments and textures as paving blocks used in the same landscaping project. Standard core blocks can be used for the support structure of a project and manufacturing efficiencies result from high volume mass production, reduced inventory requirements and the low cost materials. A customized visual appearance of the project can be achieved by selecting visible face blocks of various colours, materials, shapes, patterns, textures and surface finishes.

When core blocks are stacked to form an inside corner, the ridges in each course align and provide a continuous support for the face blocks that are hung on the ridges in the inside corner. When core blocks form an outside corner, the system described in PCT/CA2016/000211, and published U.S. Pat. No. 9,453,341 Sep. 27, 2016, uses a plastic plug having an forward head shaped with a short length of supporting ridge. The rearward end of the plug is inserted into molded holes in the core blocks for support. The face blocks in an outside corner are then hung on the heads of the plastic plugs. The grooves in the rear surface of the face blocks interlock with the ridges on the heads of the plastic plugs to support the face blocks on the core blocks.

Forming core blocks is challenging since accurate holes are required into which the plastic plugs fit. After the concrete forms are removed, the blocks can slump slightly because the concrete has not hardened or set. Slump can tend to reduce the hole diameter or hole depth which interferes with insertion of the plug when the concrete has set. The holes also weaken the block structure and increase exposure to air which changes the curing of the concrete blocks and durability. In cold climates, the holes can fill with snow or ice or debris when stored outdoors and insertion of the plugs can be impeded.

There remains a demand for an economical easily constructed structural system, for walls and stairs, for example, that ensures accurate assembly of corners with a reliable and simple method of mounting the face blocks.

Features that distinguish the present invention from the background art will be apparent from review of the disclosure, drawings and description of the invention presented below.

DISCLOSURE OF THE INVENTION

The invention provides a construction system using core blocks having a horizontal front mounting recess in the front surface defining a core detent lip, and face blocks having a horizontal rear mounting recess defining a face detent lip, and connectors for supporting stacked courses of the face blocks suspended on the front surfaces of stacked courses of core blocks, the connectors having a rear hook and a front hook, wherein the face blocks are each supported by their rear surfaces with at least one connector, by engagement of the front hook with the face detent lip and engagement of the rear hook with the core detent lip.

As noted above, construction of walls from standard molded blocks involves adapting standard blocks to build wall corners, pillars, bench walls, terraces and fireplaces for example. Factors of importance include flexibility in aesthetic design to match pavement blocks, simple construction methods, low cost, minimal inventory requirements, dimensional control and standardized manufacturing processes, which can often conflict and lead to trade offs. The system described herein provides a low cost standardized core block and customized face blocks joined with low cost durable connectors which can be readily adapted for corners, stairs, walls, pillars and other structures using minimal modification.

DESCRIPTION OF THE DRAWINGS

In order that the invention may be readily understood, an embodiment of the invention is illustrated by way of examples in the accompanying drawings.

FIGS. 25 to 29 show: a front-left isometric view; a right side view; a rear-left isometric view; a left side view; and a rear view, respectively.

FIGS. 30 to 34 show: a front-left isometric view; a right side view; a rear-left isometric view; a left side view; and a rear view, respectively.

FIG. 35 is an isometric view of an example wide wall assembly (not using connectors of FIG. 2) with foundation slab blocks laid in a lower course and with four courses of core blocks (like FIG. 1) laid with the horizontal mounting ridges on their right and left surfaces facing outward to support face blocks;

FIG. 36 shows an elevation view of the wall assembly of FIG. 35 with face blocks mounted on the horizontal mounting ridges of the core blocks;

FIG. 37 shows an elevation view like FIG. 37 but with alternating courses of core blocks and face blocks laid in an in/out staggered pattern;

FIG. 38 shows an elevation view like FIG. 37 but with a left side having face blocks only, and the core blocks and face blocks laid in a leaning or battered pattern suitable for an earth retaining wall for example;

FIG. 39 is an elevation view similar to FIG. 38 having face blocks mounted on both sides of the core blocks; and FIG. 40 is an elevation view of a lower wall with face blocks on a left side of four lower courses of core blocks and an upper seat wall of the alternative mid-course core blocks (see FIG. 15) with face blocks on both the left and right sides.

FIG. 41 shows an isometric view of a completed pillar with six alternating courses of exposed face blocks with core blocks and connectors hidden from view and a slab cap block on top;

FIG. 42 shows an isometric view of a first course of corner core blocks for the pillar of FIG. 41 with connectors and horizontal mounting ridges facing outward for mounting face blocks thereon;

FIG. 43 is an exploded isometric view of four alternating courses like FIG. 42 to form a pillar;

FIG. 44 is a plan view of the course of FIG. 42, as well as the first and third course of FIG. 43;

FIG. 45 is a plan view of the second and fourth courses of FIG. 43;

FIG. 46 shows the first and second courses of the pillar construction with face blocks installed on the first course;

FIG. 47 shows the two courses like FIG. 46 with face blocks on both the first and second courses;

FIG. 48 shows the view of FIG. 47 with a third course of corner core blocks laid thereon.

FIG. 50 shows a sectional view along line 50-50 of FIG. 51 with four levels of stairs constructed of core blocks with face blocks as risers and slab blocks as stair treads; and FIG. 51 shows a perspective view of two steps having an exposed side wall with face blocks mounted thereon.

Further details of the invention and its advantages will be apparent from the detailed description included below.

DETAILED DESCRIPTION OF PREFERRED EMBODIMENTS

Figure 1:
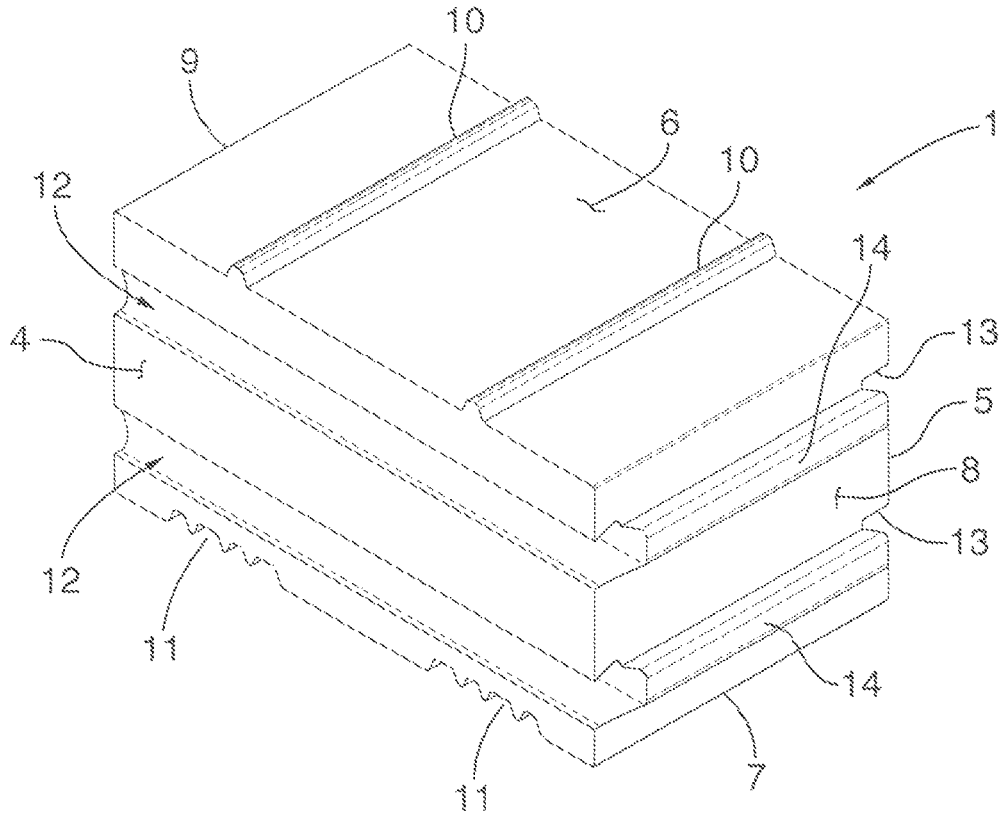
FIG. 1 is a front-top isometric view of a core block with two horizontal front mounting recesses in the front surface, two slots in the rear surface, two horizontal mounting ridges in the left side surface for mounting face blocks, and matching alignment ridges and alignment grooves in the top and bottom surfaces.

FIG. 1 shows a slip molded core block 1, or quoin block, that is especially adaptable for constructing corner assemblies due to the ability to support face blocks on at least three sides, but is also adaptable for use in other common structures. Adaptability to multiple uses and structures is a common characteristic of generally rectangular bricks and blocks.

Figure 15:
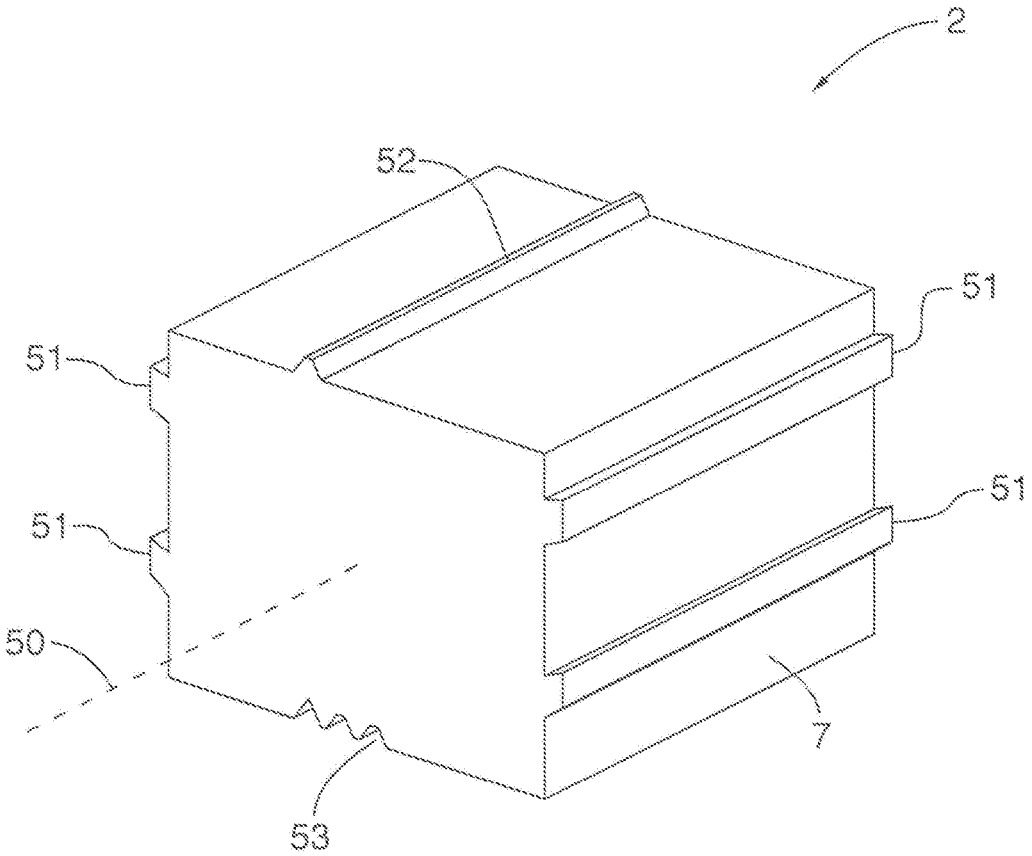
FIG. 15 is an isometric view of an alternative mid-course core block suitable for laying courses between corner assemblies such as shown in FIGS. 9-10.

FIG. 15 shows an slip molded alternative mid-course core block 2 as described in PCT/CA2016/000211. The alternative core blocks 2 do not utilize the connectors 3 for mounting face blocks and therefore can be a more simple slip molded shape with planar side surfaces without grooves or ridges. The alternative core blocks 2 are suitable for filling in the mid-course between outside and inside corner assemblies (shown in FIGS. 16-18) that are constructed of the core blocks 1 (FIG. 1) that are preferred for corner construction.

Figure 2:
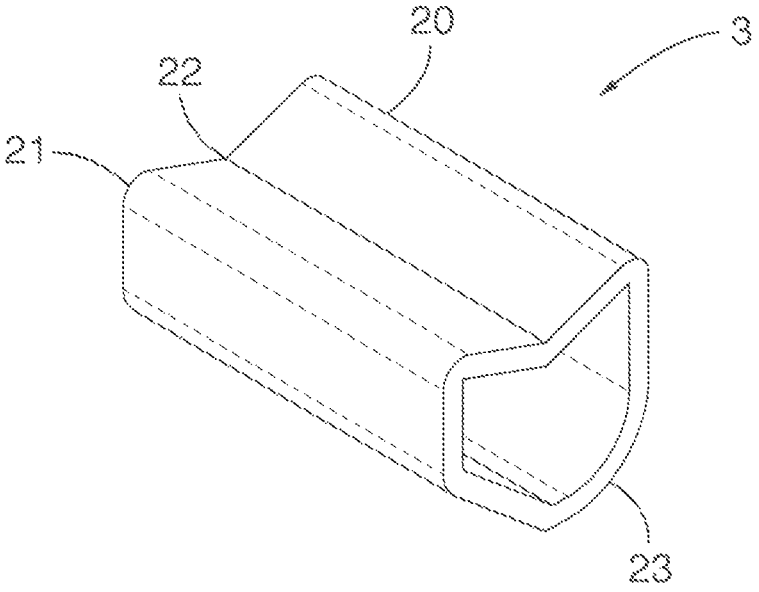
FIG. 2 is an isometric view of a tubular connector having a rear hook engaging the rear mounting recesses of the core blocks, and having a front hook for engaging the rear mounting recesses of the exposed face blocks.

FIG. 2 shows a connector 3 for supporting various slip molded face blocks 24, 40, 44, 47 on the core blocks 1, 2. Details of the face blocks 24, 40, 44, 47 are shown in FIGS. 19-32.

Figure 50:
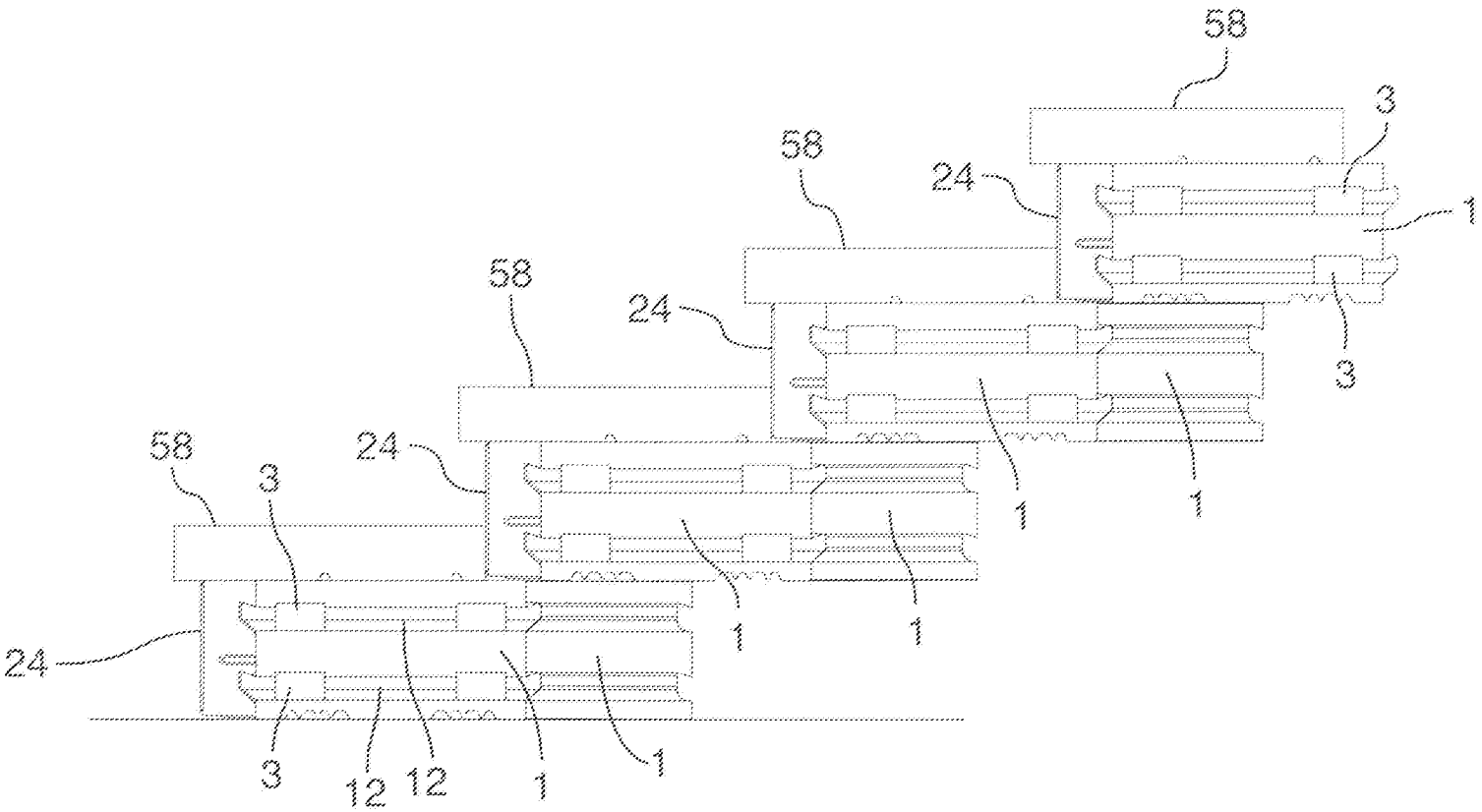
FIGS. 50-51 show views of a stair assembly made from the corner core blocks, connectors and face blocks, namely.
Figure 51:
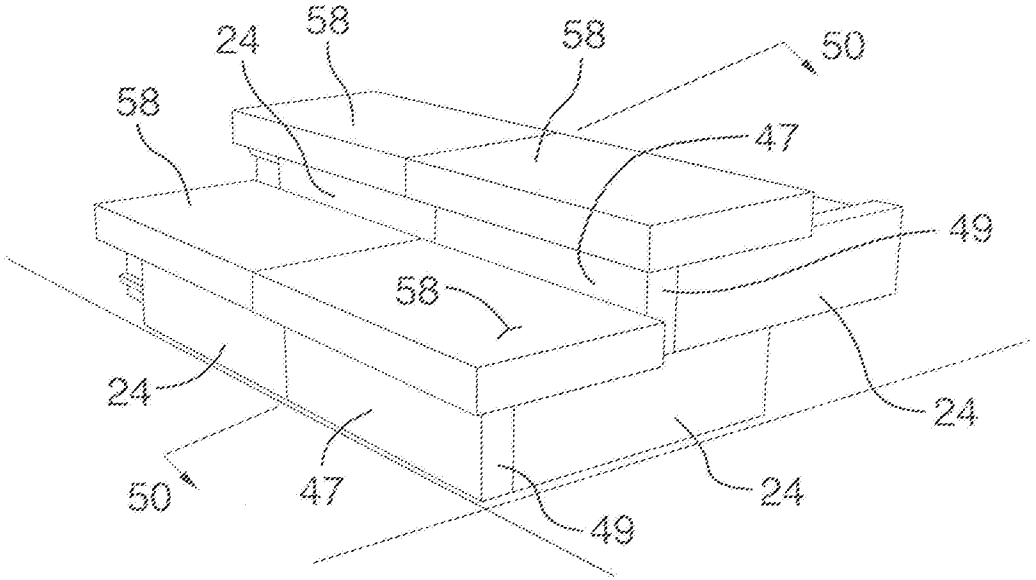

From these three simple components, with foundation slabs 55 and cap stones 57 as needed, the core of various structures can be easily constructed, for example, walls (FIGS. 16-18), pillars (FIGS. 41-48), and stairs (FIGS. 50-51). On the inner core structure, various face blocks 24, 40, 44, 47 are hung to provide a visible decorative outer layer of face blocks 24, 40, 44, 47.

Figure 53:
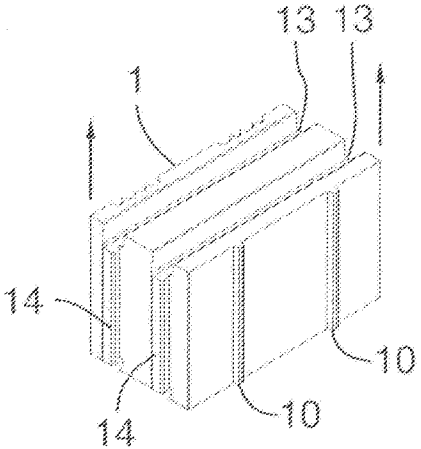
FIG. 53 shows a single core block as slip molded.
Figure 54:
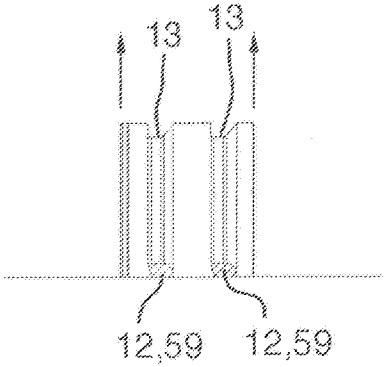
FIG. 54 shows a side view of the core block as molded in FIG. 53.

The slip molded core block 1, shown in FIGS. 1, 12-14, has: a front surface 4; a rear surface 5; a top surface 6; a bottom surface 7; a left side surface 8; and a right side surface 9. The top surface 6 has two alignment protrusions 10 and the bottom surface 7 has multiple alignment grooves 11. The core block 1 is slip molded to form the parallel surfaces 6, 7, 8, 9 as indicated with arrows in FIGS. 52-54. The use of alignment protrusions 10 and alignment grooves 11 and slip molding manufacturing procedures are considered to be well known by those in the trade, are described in international patent application PCT/CA2016/000211 and need not be discussed in detail herein. The alignment protrusions 10 and alignment grooves 11 are adapted for interlocking the core blocks 1 together and aligning core blocks 1 accurately in stacked courses with the left and/or right side surfaces 8, 9 adjacent to like core blocks 1. When corners are constructed of core blocks 1, the alignment protrusions 10 on a lower course that interfere with placement of an upper course, can be easily removed with a chisel or grinder. Adhesives applied to the top surfaces of the core blocks 1 serves to retain the core blocks 1 in place.

Figure 7:
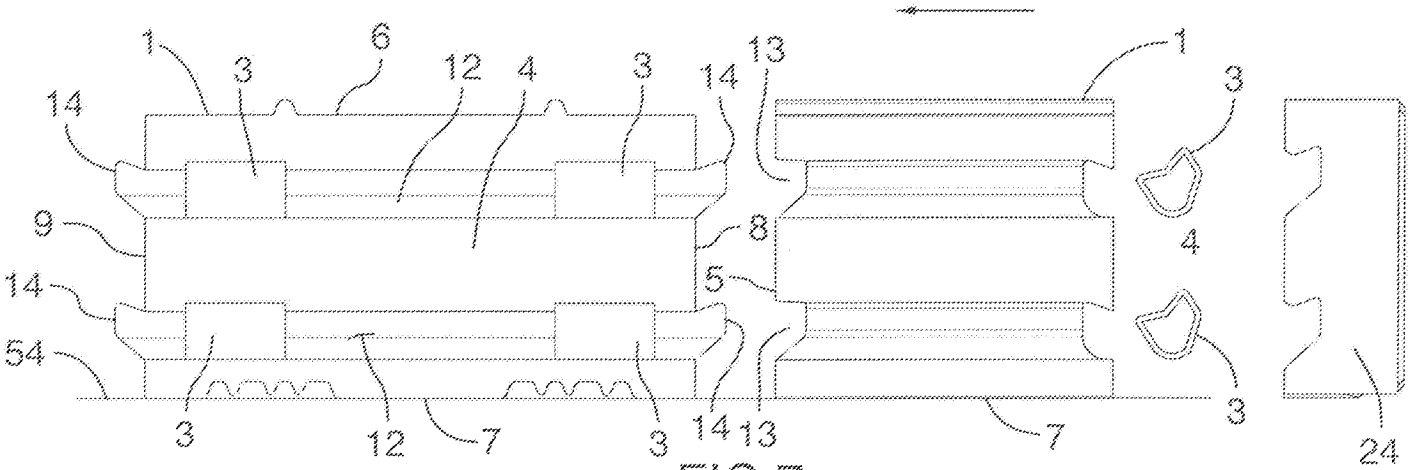
FIG. 7 is an elevation view of an outside corner assembly of two core blocks showing four connectors mounted in the two horizontal front mounting recesses of the core block to the left and alignment of the slot in the rear surface of the core block arranged perpendicularly to the right to abut the left surface of the core block to the right.
Figure 8:
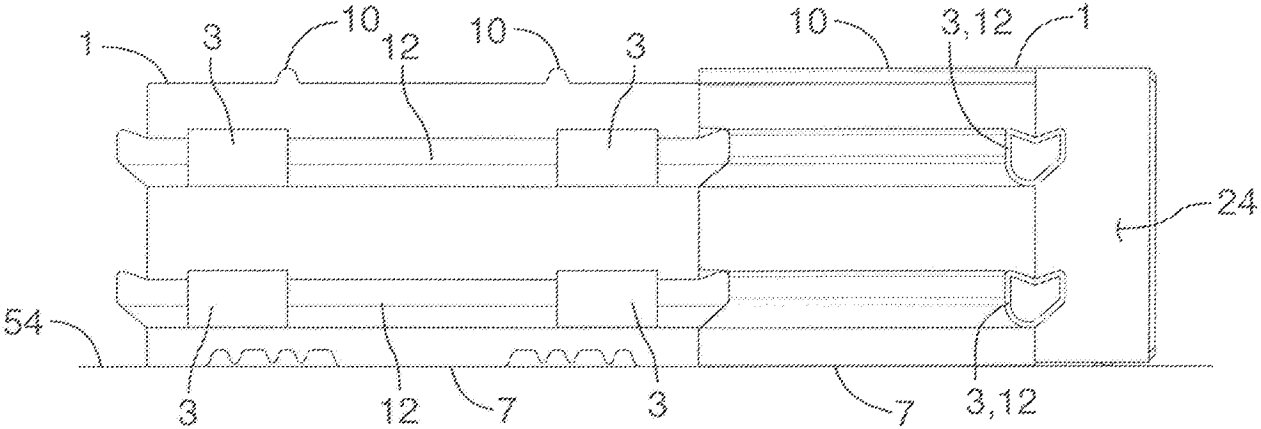
FIG. 8 is an elevation view like FIG. 7 with the slots and ridges engaging the core blocks together by sliding the right core block to the left.

Each core block 1 as illustrated in the example shown has two horizontal front mounting recesses 12 in the front surface 4. The rear surface 5 of the example core block 1 includes two slots 13 the function of which is best illustrated in FIGS. 7-8 for receiving the horizontal mounting ridge 14 of an adjacent core block 1. Further explanation of these features will follow. A single recess 12, a single slot 13 or multiple recesses and slots 12, 13 can be provided if desired, for example when thinner of thicker blocks are made.

FIGS. 11-14 show different views of the core block 1 to clarify the arrangement of various features including: the two horizontal front mounting recesses 12; the two slots 13; mounting ridges 14 on both left and right side surfaces; alignment protrusions 10; and alignment grooves 11.

Figure 3:
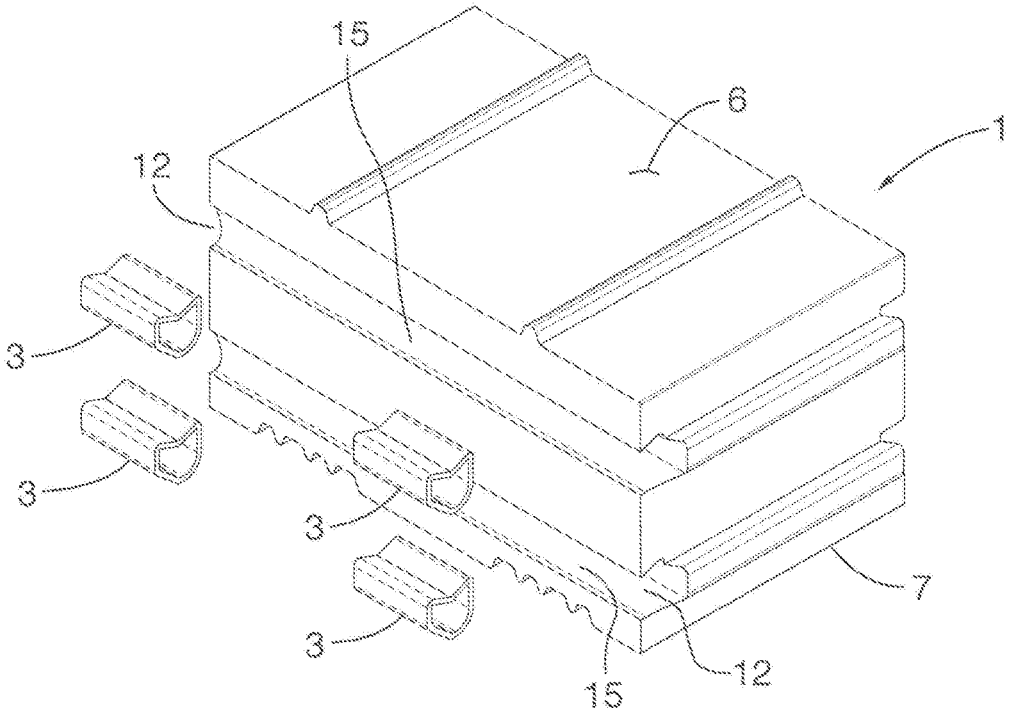
FIGS. 3 and 5 are front-top isometric views of a core block and four connectors showing the connectors disengaged and engaged respectively in the two horizontal front mounting recesses in the front surface of the core block.
Figure 4:
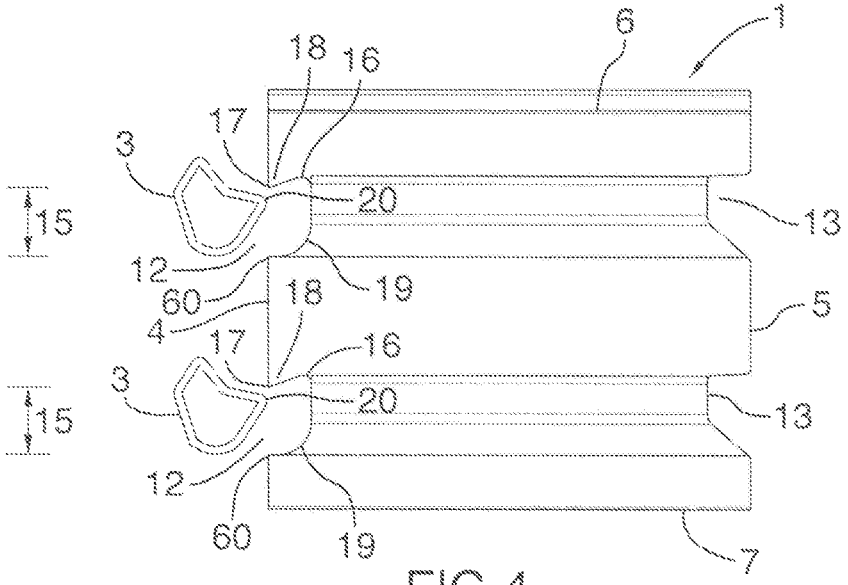
FIGS. 4 and 6 are left side elevation views corresponding to FIGS. 3 and 5 respectively.

As best seen in FIGS. 3-4, the horizontal front mounting recess 12 with a uniform cross-sectional profile. To receive the connectors 3, the horizontal front mounting recess 12 has a front opening 15. An upper core pocket 16 extends rearwardly and upwardly from a top edge 17 of the front opening 15 defining a core detent lip 18. A core base 19 extends rearwardly from a bottom edge 60 of the front opening 15 to the upper core pocket 16.

Figure 5:
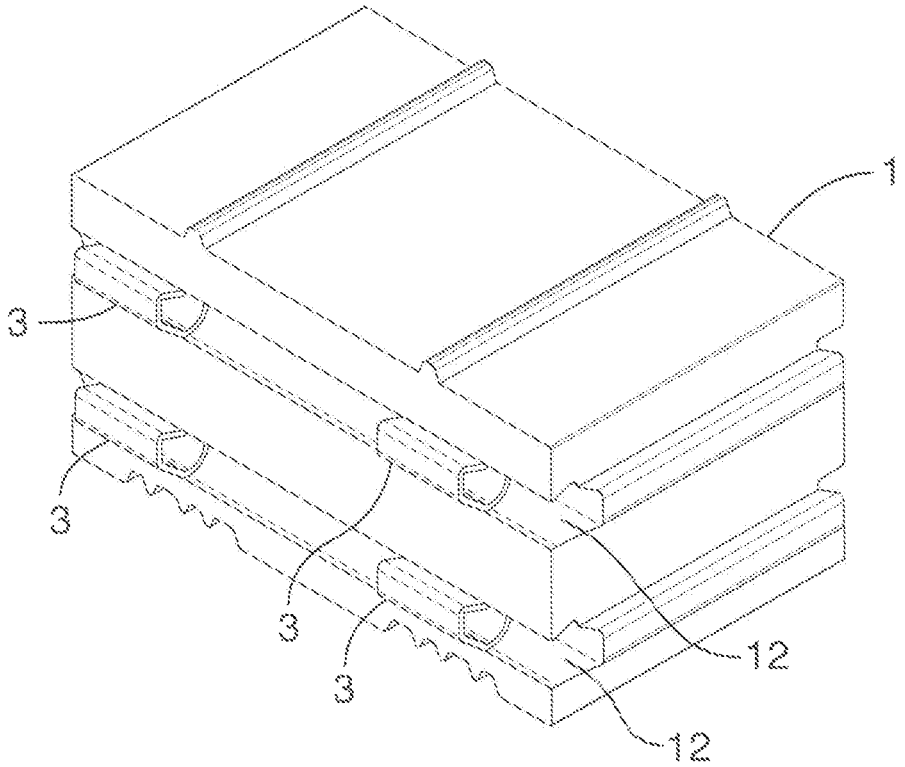
Figure 6:
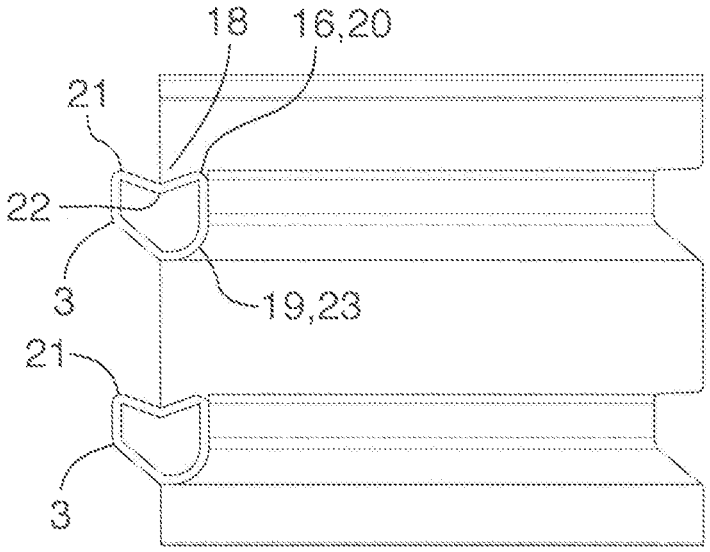

In FIGS. 3-6, four connectors 3 are shown that are mounted into the horizontal front mounting recesses 12. Any number or length of connectors 3 can be used. Details of the connectors 3 are shown in FIG. 2. As described below, the connectors 3 are used for supporting stacked courses of the face blocks 24, 40, 44, 47 suspended on the front surfaces 4 of the stacked courses of core blocks 1. The connectors 3 have a rear hook 20 and a front hook 21 defined on two sides of a top recess 22 in the top surface. The bottom surface 23 of the connector 3 is shaped for engaging the core base 19 of the horizontal front mounting recess 12 of the core blocks 1 as shown in FIG. 5-6. In the example illustrated the bottom surface 23 of the connector 3 is convex and the contour of the core base 19 is concave, the connector 3 and horizontal front mounting recess 12 each have a mating uniform cross-sectional profile since these shapes are simple to form, but other shapes that engage and support the connectors 3 and horizontal front mounting recess 12 are possible as well. The connector 3 in the example is a hollow tube that can be inexpensively extruded from plastic, rubber or aluminum and can be cut to any desired length with a saw. Solid or reinforced connectors 3 are also possible if increased strength is necessary.

Figure 19:
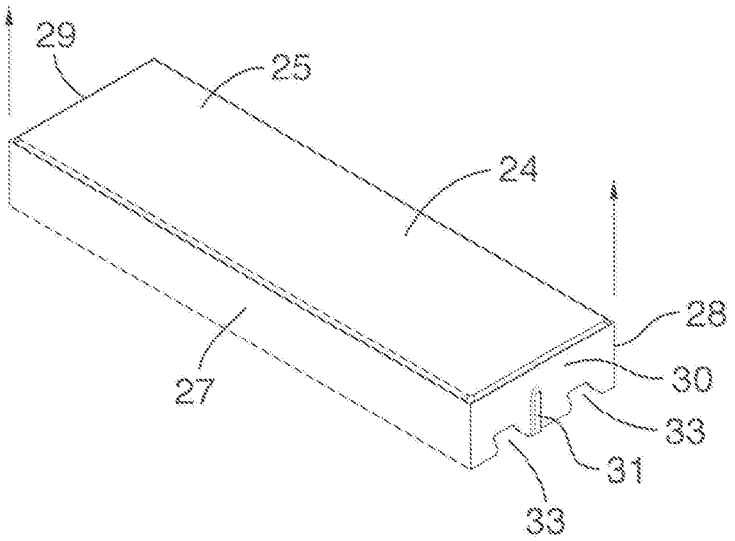
FIG. 19 is a front right isometric view of a full length face block having a uniform cross-sectional profile throughout its length.
Figure 20:
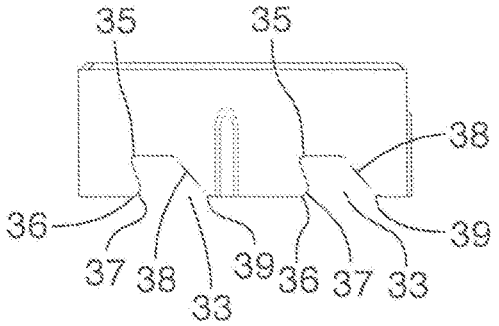
FIG. 20 is a right side view of the face block of FIG. 19.
Figure 21:
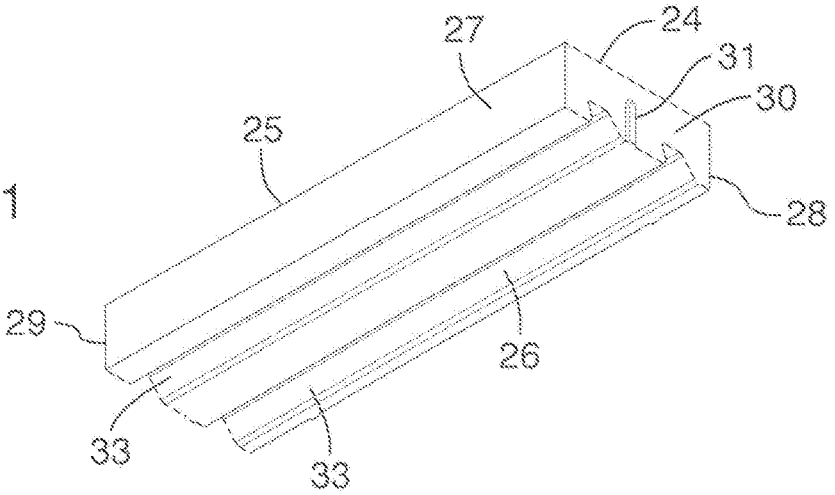
FIG. 21 is a rear right isometric view of the face block of FIG. 19.
Figure 22:
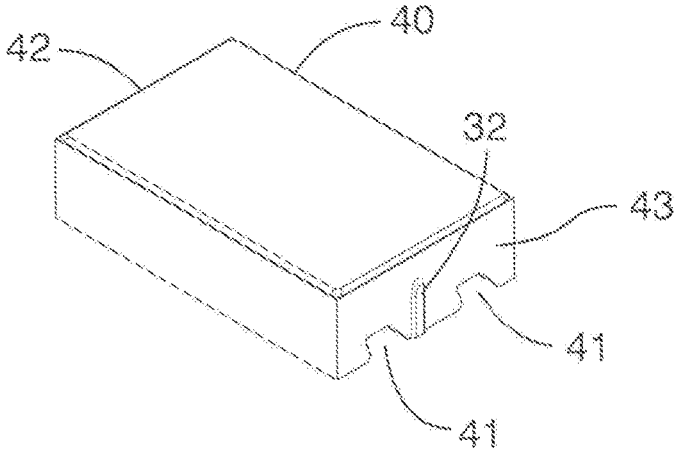
FIGS. 22, 23 and 24 show a half-length face block with views corresponding to FIGS. 19, 20 and 21 respectively.
Figure 23:
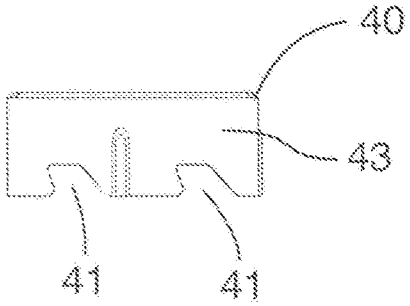
Figure 24:
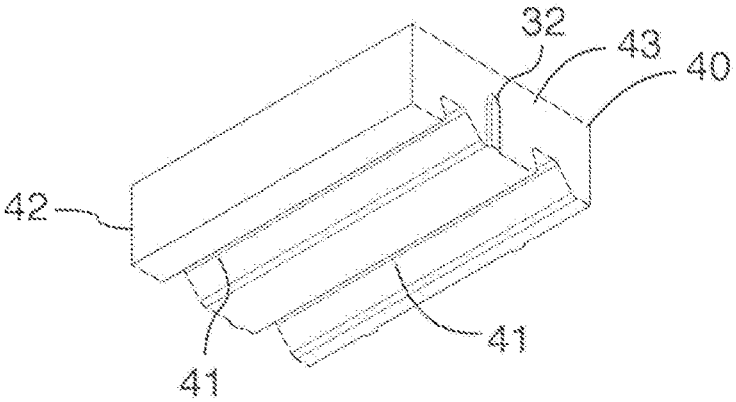
Figure 26:
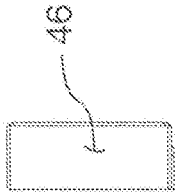
FIGS. 25 to 29 show a full length face block similar to FIGS. 19 to 21 but having two parallel rear mounting recesses with a closed right end, for a corner assembly (see the first course of face blocks in FIG. 18), where
Figure 28:
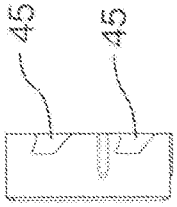
Figure 29:
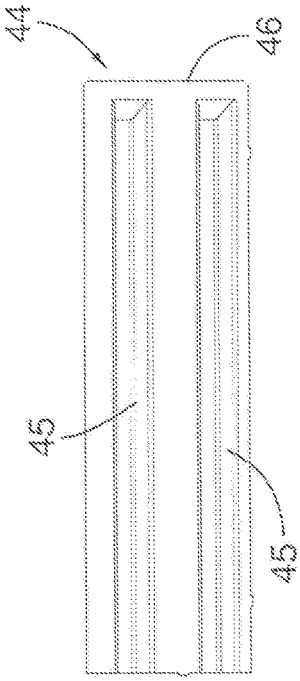
Figure 25:
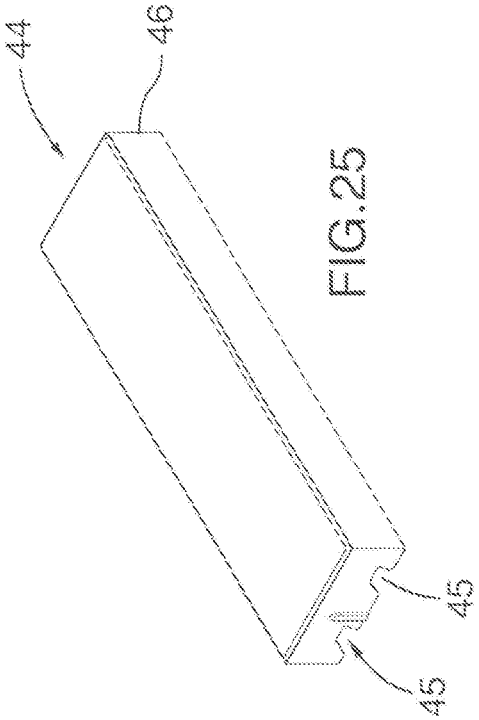
Figure 27:
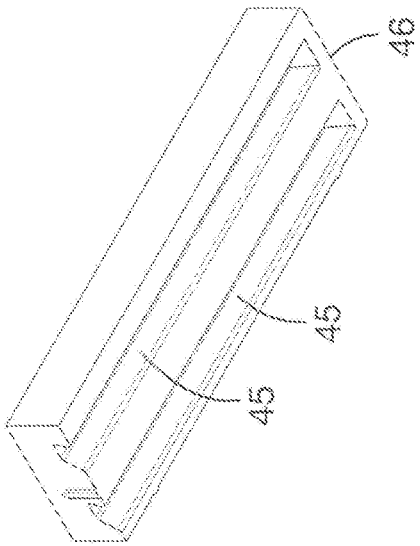
Figure 31:
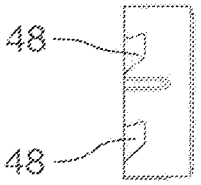
FIGS. 30 to 34 show a full length face block similar to FIGS. 25 to 29, but having a closed left end for a corner assembly (see the second course of face blocks in FIG. 18), where
Figure 33:
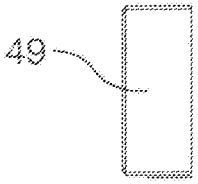
Figure 34:
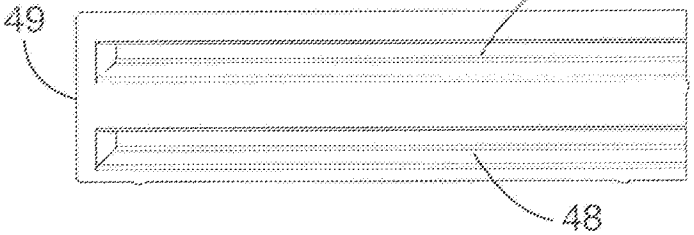
Figure 30:
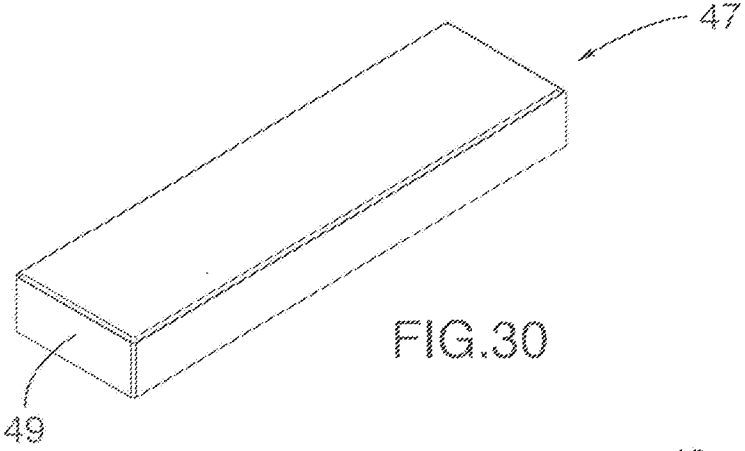
Figure 32:
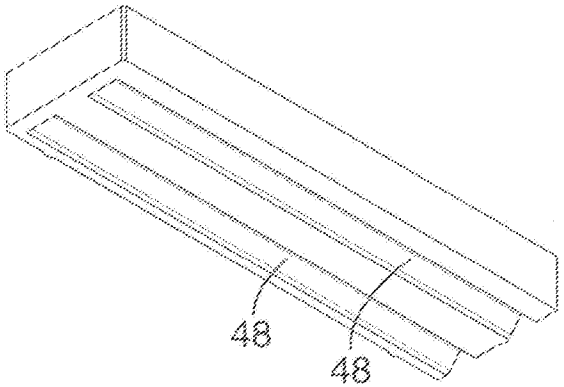

The face blocks 24, 40, 44, 47 shown in FIGS. 19 to 34 are hung on the connectors 3 that are supported within the horizontal front mounting recesses 12 of the core blocks 1. FIGS. 19 to 21 show a full length face block 24 having a uniform cross-sectional profile throughout its length. The full length face block 24 is slip formed in the direction indicated by an arrow in FIG. 19 in a manner like a paving stone. The exposed front surface 25 and side surfaces 27-30 can be coloured, treated and processed in many ways to achieve various decorative features like paving stones to match or complement paving stones used in a construction project.

Referring to FIGS. 19-21, using the example of a full length face block 25, each face block has: an exposed front surface 25; a rear surface 26; a top surface 27; a bottom surface 28; a left side surface 29; and a right side surface 30. Spacer ridges 31 are provided on surfaces 28-30 to abut adjacent face blocks when installed in a wall structure for example. The rear surface 26 of each full length face block 24 in the example shown has two horizontal rear mounting recesses 33 extending the entire length of the block 24. Similar to the horizontal front mounting recess 12 in the core blocks 1, the horizontal rear mounting recesses 33 in the full length face blocks 24 have a uniform cross-sectional profile defined by a rear opening 34, an upper face pocket 35 extending rearward and upward from a top edge 36 of the rear opening 34 defining a face detent lip 37, and a face base 38 extending rearwardly from a bottom edge 39 of the rear opening 34 to the upper face pocket 35. As indicated in FIGS. 7-8, the face blocks 24 are each supported by their rear surfaces 26 with at least one connector 3, by engagement of the front hook 21 of the connector 3 with the face detent lip 37 and engagement of the rear hook 20 with the core detent lip 18. Since each face block 24 has a center of gravity located at an eccentric distance from the rear surface 26, gravity will rotate the rear surface 26 of each face block 24, around the front hook 21 of the connector 3, towards the front surface 4 of the adjacent core block 1.

In the example shown in FIG. 2, the front hook 21 of the connector 3 has a cross-sectional profile to match the profile of the horizontal rear mounting recesses 33 and to engage the face detent lip 37 and upper face pocket 35. The face block 24 can be simply held by gravity hanging on the front hooks 21 of the connectors 3, and confined by adjacent face blocks 24 laterally, above and below. If desired compatible adhesives can be used to further secure the face blocks 24, connectors 3 and core blocks 1 together.

Referring to FIG. 1, the core blocks 1 can be used to support face blocks 24, not only on connectors 3 mounted in the horizontal front mounting recesses 12, but also using horizontal mounting ridges 14 on the left side surface 8 and on the right side surface 9. At least one or both of the left side surface 8 and the right side surface 9 of the core blocks 1 includes one or more horizontal mounting ridges 14 for supporting the face blocks 24 by their rear surfaces 26 by engagement of the horizontal mounting ridge 14 with the face detent lip 38 of each horizontal rear mounting recess 33.

Different configurations of face blocks are shown in FIGS. 19 to 34. The size, shape and surface features of face blocks 24, 40, 44, 47 are only limited by the need to match the rear surface 26 and horizontal rear mounting recesses 33, 41, 45, 48 with the abutting core block surface. The front, top, bottom, left and right side surfaces of the face blocks 24, 40, 44, 47 may be adapted to any desired configuration including for example using natural stone slabs with horizontal rear mounting recesses 33, 41, 45, 48 cut in a rear mounting surface.

In the example of FIGS. 19-21, a full length face block 24 has two horizontal rear mounting recess 33 extending the complete width of the block 24 from the left side surface 29 to the right side surface 30. In the example shown in FIGS. 22-24, a half length face block 40 also has horizontal rear mounting recess 41 that extends completely from the left side surface 42 to the right side surface 43. A spacer ridge 32 is also provided on the side surfaces.

The full length face block 24 and half length face block 40 are suitable for installation where the left side surface 29, 42 and the right side surfaces 30, 43 are not exposed and not visible. For example mid-course between corner assemblies or where blocks 24 and 40 are otherwise abutting another block that covers the horizontal rear mounting recesses 33, 41, the side surfaces 29, 30, 42 and 43 are not visible in the finished wall.

Figure 18:
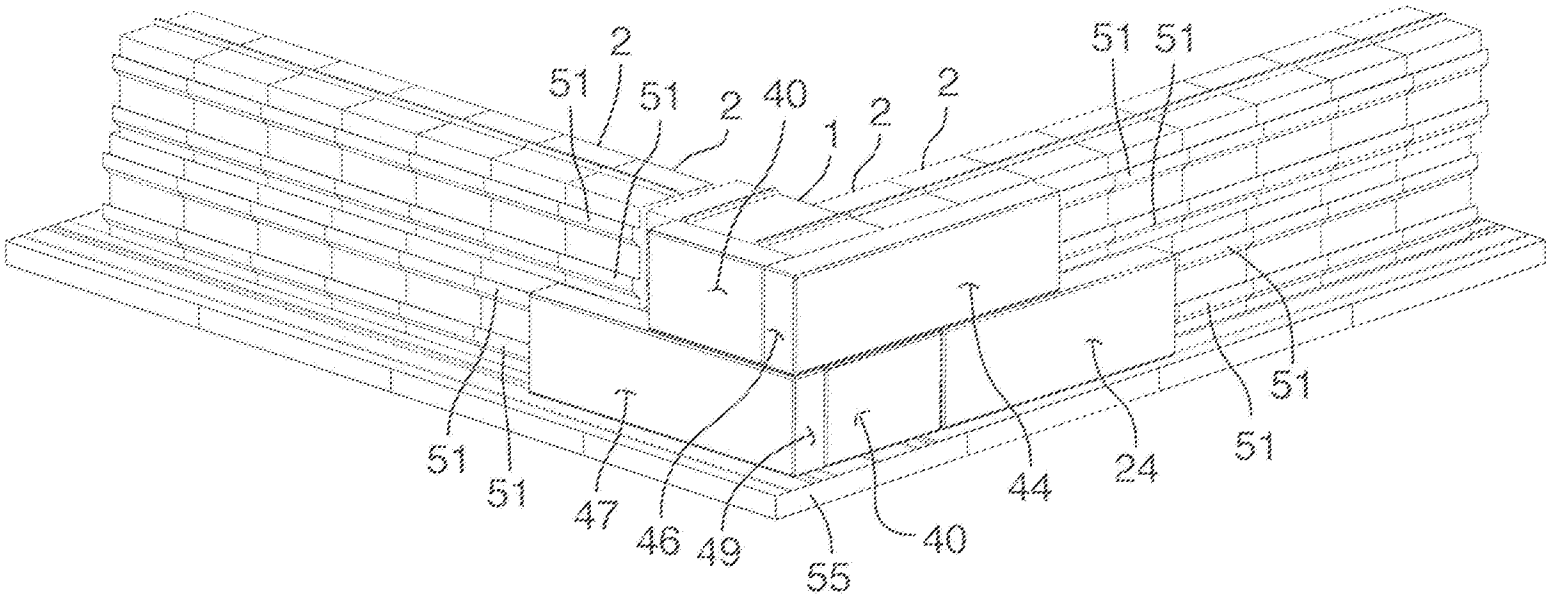
FIG. 18 is a perspective view like FIG. 17 with face blocks mounted on the connectors and mounting ridges.

In the example of FIGS. 25-29, a closed right end face block 44 has two parallel horizontal rear mounting recesses 45 with a closed right end 46 for use where the right end 46 is visible or exposed such as in a corner assembly (see the first course of face blocks in FIG. 18). In an opposite example of FIGS. 30-34, a closed left face block 47 has two parallel horizontal rear mounting recesses 48 with a closed left end 49 for use where the left end 46 is visible or exposed such as in a corner assembly (see the second course of face blocks in FIG. 18). In either case the horizontal rear mounting recess 45, 48 for a corner face block 44, 47 has a closed right or left end 46, 49 adjacent to the right side surface or the left side surface, the purpose of which is to present a finished side surface used in corner assemblies, stairs, pillars or other structures where a visible open mounting recess 45, 48 is undesirable.

Figure 16:
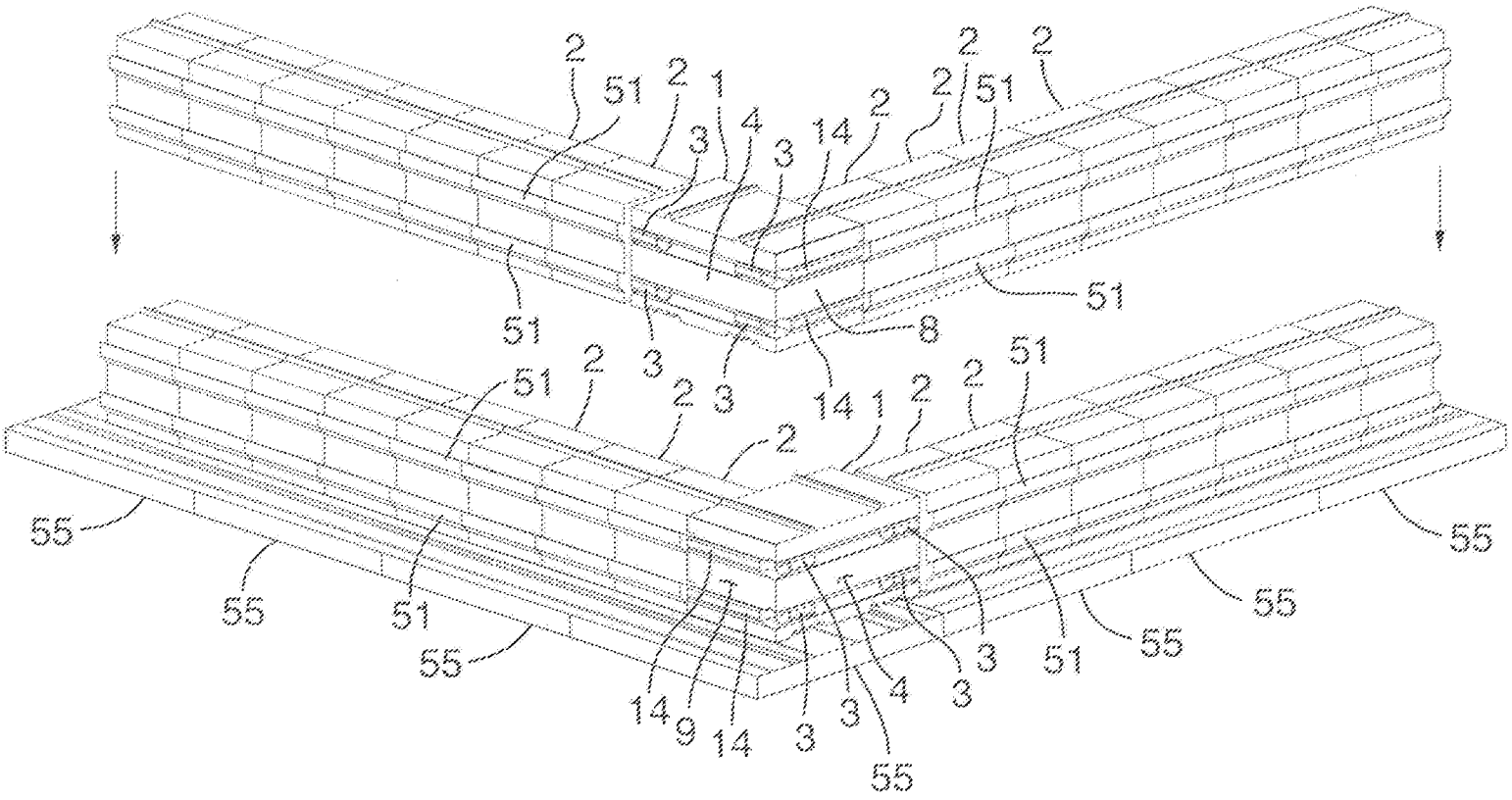
FIG. 16 is an exploded perspective view of an example wall assembly with a lower foundation course of slab blocks, a first course with a corner core block (as in FIG. 4 but reversed) with the alternative mid-course core blocks of FIG. 15 and a second course with a corner core block (as in FIG. 4) with alternative mid-course core blocks in an alternating running pattern.
Figure 17:
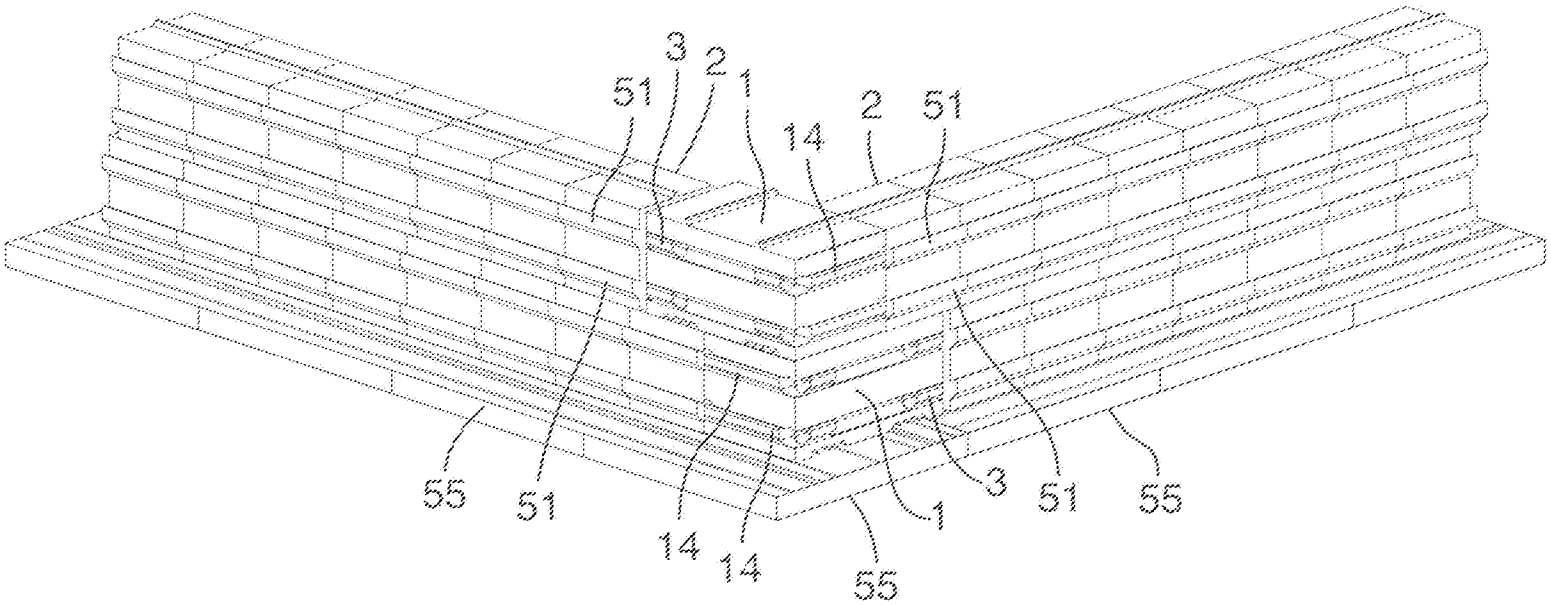
FIG. 17 is a perspective view like FIG. 16 with the second course laid on the first course, the corner core blocks including connectors mounted in the front mounting recesses, and having horizontal mounting ridges extending along each course on the exposed outward surfaces.

An alternative core block 2 is shown in FIGS. 1 and 16-18. The alternative core block 2 is a solid shape slip molded along the central axis 50 and having a uniform cross-section. On front and rear surfaces, two horizontal mounting ridges 51 are shown on which the horizontal rear mounting recesses 33, 41, 45, 48 of the face blocks 24, 40, 44, 47 are engaged as shown in FIG. 18. The alternative core block 2 also includes alignment protrusions 52 and alignment grooves 53 to align stacked courses of blocks 2 together as seen in FIG. 16-18.

The standard components described above can be assembled together in multiple ways, including corner assemblies of core blocks 1, 2 clad with face blocks 24, 40, 44, 47.

FIGS. 3-4 show the core block 1 having a front surface 4 with two horizontal mounting recesses 12 and four connectors 3 (details shown in FIG. 2) in exploded view spaced apart and oriented for insertion of the rear hook 20 of the connector 3 into engagement with the upper core pocket 16. FIGS. 5-6 show the rear hook 20 of the connector 3 rotated and inserted into the upper core pocket 16 of the two horizontal mounting recesses 12. The convex bottom surface 23 of the connector 3 engages the matching concave surface of the core base 19 of the two horizontal mounting recesses 12, and is supported to resist vertical loading applied by the weight of face blocks 24, 40, 44, 47 that are to be hung on the front hook 21. The core detent lip 18 is engaged in the top recess 22 of the connector 3 and resists forward movement. The connectors 3 in the installed position shown in FIGS. 5-6 can be installed and removed by rotating into the recess 12 (clockwise as drawn) but not by vertical force on the front hook 21 since the connector 3 rests on the core base 19 of the recess 12.

The tubular shape of the connectors 3 may be marginally flexible so that the connectors 3 snap lock into the matching recesses 12. Insertion of a connector into the horizontal mounting recess 12 preferably requires a slight inward compressive force applied manually. As a result the flexible connector 3 when installed into the recess 12 exerts an outward resilient force or spring back on the horizontal mounting recesses 12 thus retaining the connector 3 in position until the face blocks 24, 40, 44, 47 are installed on the connectors 3. The connectors 3 could also be retained in the recesses 12 by applying adhesives to the matching surfaces.

FIGS. 7-10 show the stages to construct a corner assembly using two core blocks 1 per course. Alternatively FIGS. 16-18 show the stages to construct a corner assembly using a single core block 1 per course with alternative core blocks 2 running mid-course. In both cases the use of a novel core block 1 with connectors 3 enables face blocks 24, 40, 44, 47 to be installed on two perpendicular side surfaces of each core block 1 of the corner assembly in a simple low cost manner.

Figure 9:
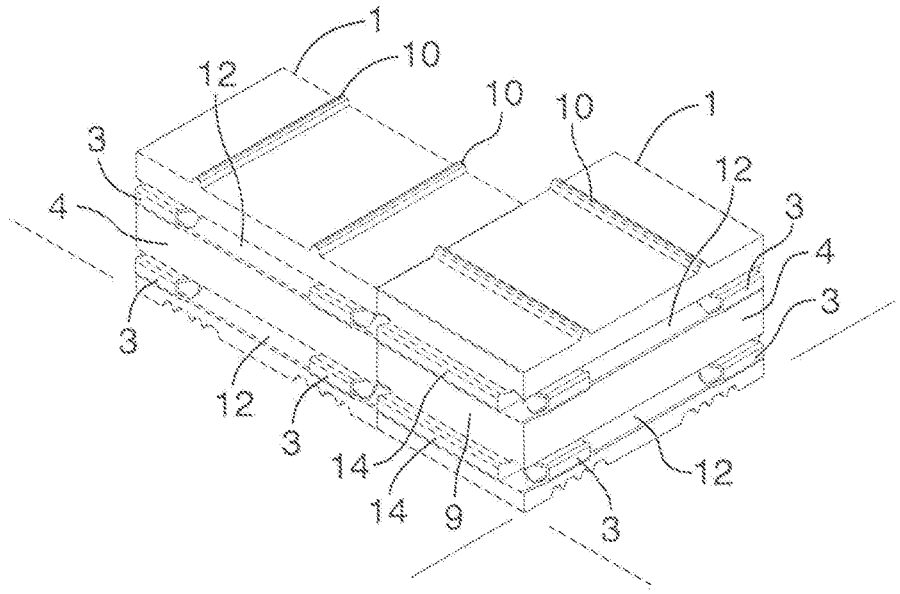
FIG. 9 is a top isometric view of the two core blocks shown in FIG. 8 to illustrate the formation of an outside corner assembly.
Figure 10:
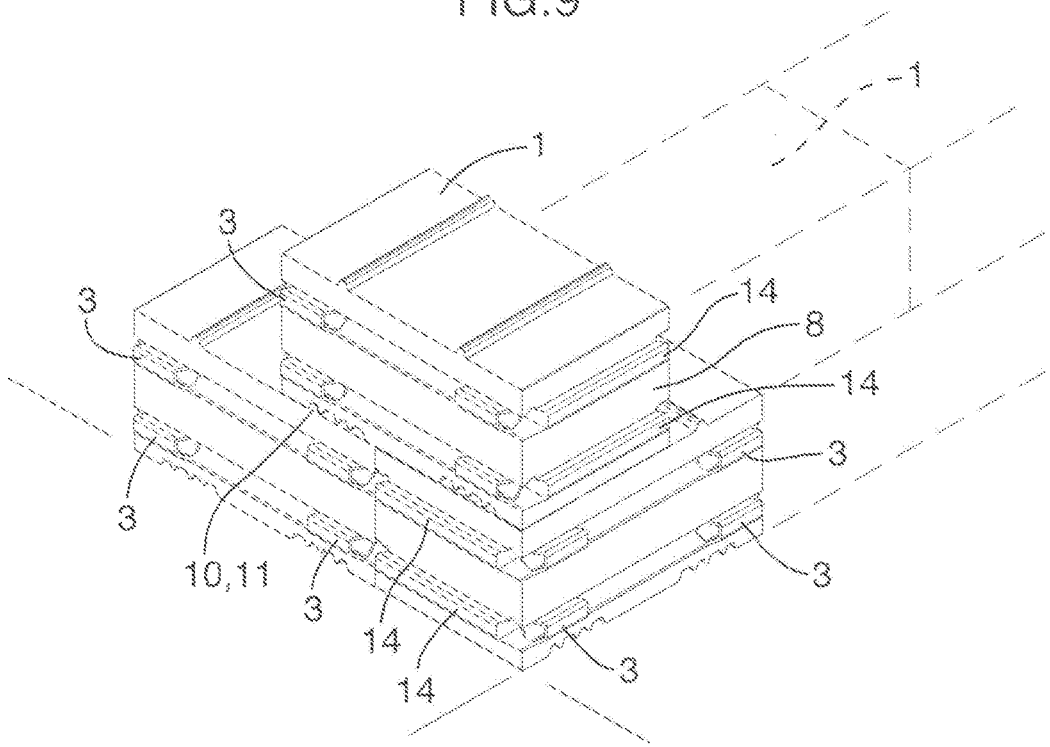
FIG. 10 is an isometric view like FIG. 9 with a core block of a second course laid on the lower course.
Figure 11:
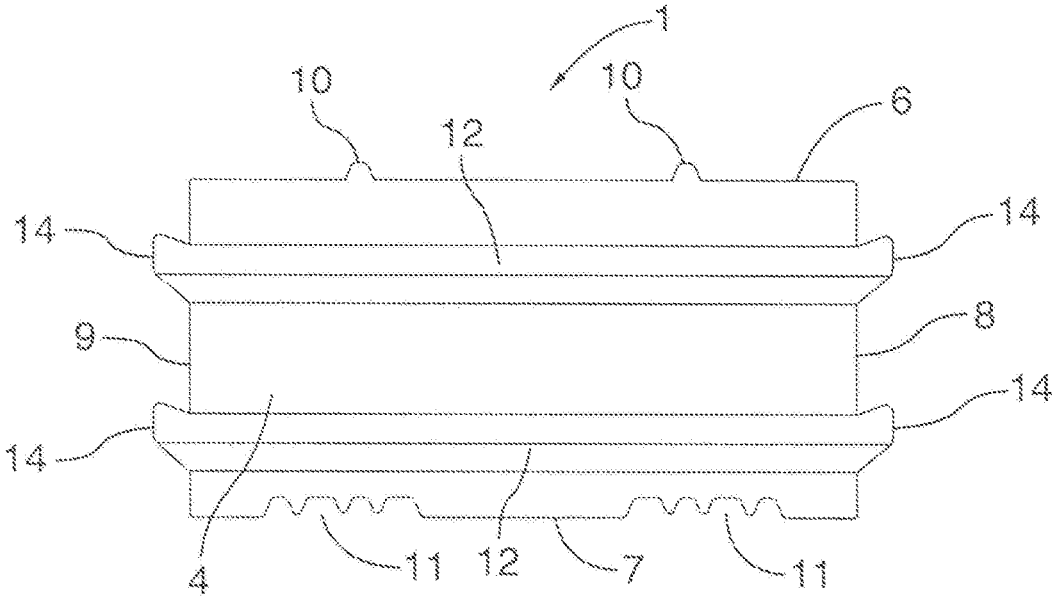
FIG. 11 is a front surface view of the core block.
Figure 12:
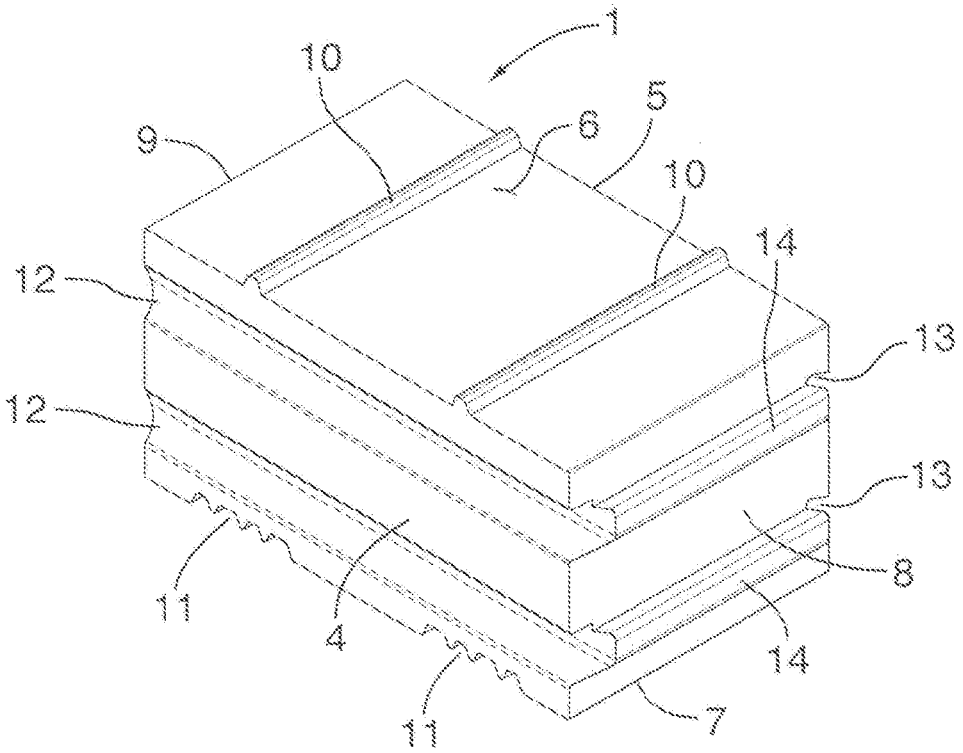
FIG. 12 is a front-top isometric view of the core block like FIG. 1.
Figure 13:
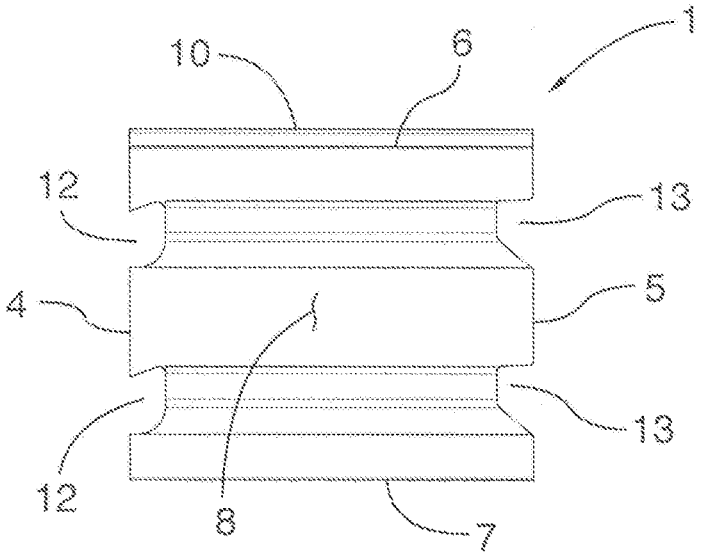
FIG. 13 is a left side surface view of the core block.
Figure 14:
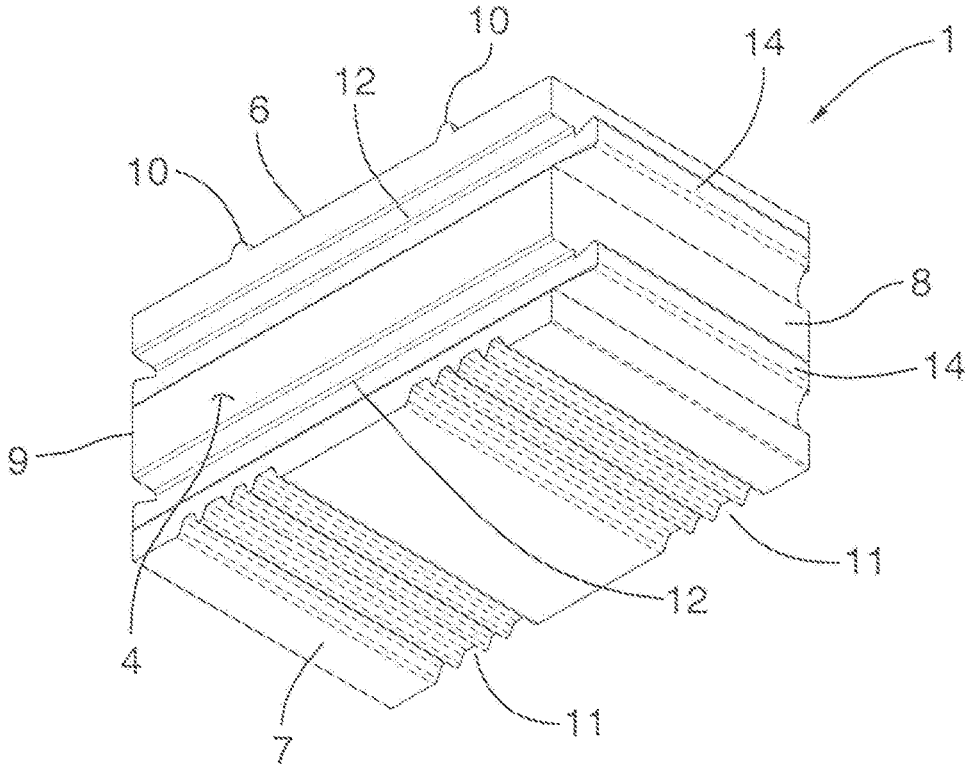
FIG. 14 is a front-bottom isometric view of the core block.

FIGS. 7-9 show views of two identical core blocks 1 arranged perpendicular to each other to start a corner assembly with a first course of core blocks 1. The progression from FIG. 7 to FIG. 8 shows the alignment of the bottom surfaces 7 of both core blocks on a level surface 54. The level surface 54 may be a course of precast concrete slabs, a poured concrete pad, or a compacted layer of limestone screenings, for example. FIG. 7 shows the horizontal alignment of the mounting ridges 14 of the core block 1 on the left and the slots 14 of the core block 1 on the right. Connectors 3 are installed in the horizontal front mounting recesses 12 of both core blocks 1 which can be seen in all views of FIGS. 7-9. The horizontal rear mounting recesses 33 of the face block (one or more of 24, 40, 44, 47) are later engaged on the connectors 3 as indicated in FIG. 8, however in general the core block 1 are assembled first and face blocks 24, 40, 44, 47 are mounted afterwards. FIG. 8 shows the abutment of the left surface 8 of the core block 1 to the left with the rear surface 5 of the core block 1 to the right and the insertion of the horizontal mounting ridges 14 into the slots 13 to form a first course perpendicular corner assembly. To place the second or upper course, an alignment protrusion 10 of the core block 1 to the right is removed with a chisel or by grinding. As seen in FIG. 10, the second course is placed by engaging the alignment groove 11 of the upper core block 1 with the alignment protrusion 10 of the lower first course core block 1 to the left. Adhesives may be applied to the top and bottom surfaces to ensure core blocks 1 remain interconnected when an alignment protrusion 10 is removed. The two courses of core blocks 1 in FIG. 10 form an outside corner with connectors 3 and horizontal mounting ridges 14 alternating in courses and facing outward to support face blocks 24, 40, 44, 47 in a subsequent step.

Stated in general, in the first course shown in FIG. 9 front surface 4 of the left core block 1 and the right side surface 9 of the right core block are aligned in a vertical plane. The horizontal mounting ridges 14 of the left core block 1 are disposed within the slots 13 of the right core block 1. In the second course, begun in FIG. 10, the opposite orientation is placed to overlap joints in a running bond course common in the trade. Specifically in a second course, the left side surface 8 of the corner core block 1 of the second course and the front surface 4 of a core block 1 (shown in phantom outline) to be placed to its right are aligned in another perpendicular vertical plane. The horizontal mounting ridges 14 of the right side surface 9 of the right core block 1 (in phantom outline) are disposed within the slots 13 of the left core block 1.

FIGS. 16-18 shows an example of the use of a simple alternate core block 2 (see FIG. 15) in a corner wall assembly. A foundation course is laid of slab blocks 55 on a compacted substrate such as gravel or limestone screening. The first course starts with a single core block 1 on the corner with a front surface 4 having connectors 3 installed and a right side 9 having two mounting ridges 14 facing outward. The remainder of the first course shown in FIG. 16 is made up of alternate core blocks 2 (see FIG. 15) laid in a running pattern with their horizontal mounting ridges 51 facing outward.

The second course shown in FIG. 16 begins with a corner core block 1 oriented to be perpendicular to and on top of the core block 1 of the first course. In an alternating manner the single core block 1 on the corner has a front surface 4 having connectors 3 installed and a left side 8 having two mounting ridges 14 facing outward. The remainder of the second course is also made up of alternate core blocks 2 laid in a running pattern with their horizontal mounting ridges 51 facing outward.

FIG. 17 shows the foundation course of slab blocks 55, first course with a corner core block 1 and alternative core blocks 2, a second course with a corner core block 1 and alternative core blocks 2, with connectors 3 and mounting ridges 14, 51 facing outward to receive face blocks 24, 40, 44, 47.

FIG. 18 shows the corner assembly of FIGS. 16-17 with face blocks 24, 40, 44, 47 installed. Starting from left to right, the first course corner includes: a closed left end face block 47 (see FIGS. 30-34) with closed left end 49 exposed; a half length face block 40 (see FIGS. 22-24) to start the alternating course pattern; and a full length face block 24 (see FIGS. 19-21). Starting from left to right, the second course corner includes: a half length face block 40; a closed right end face block 44 (see FIGS. 25-29) with closed right end 46 exposed. In the example shown, the remainder of the first and second courses will be installed with a running or alternating pattern of full length face blocks 24 mounted on the ridges 51 until another corner or other feature is required.

Figure 35:
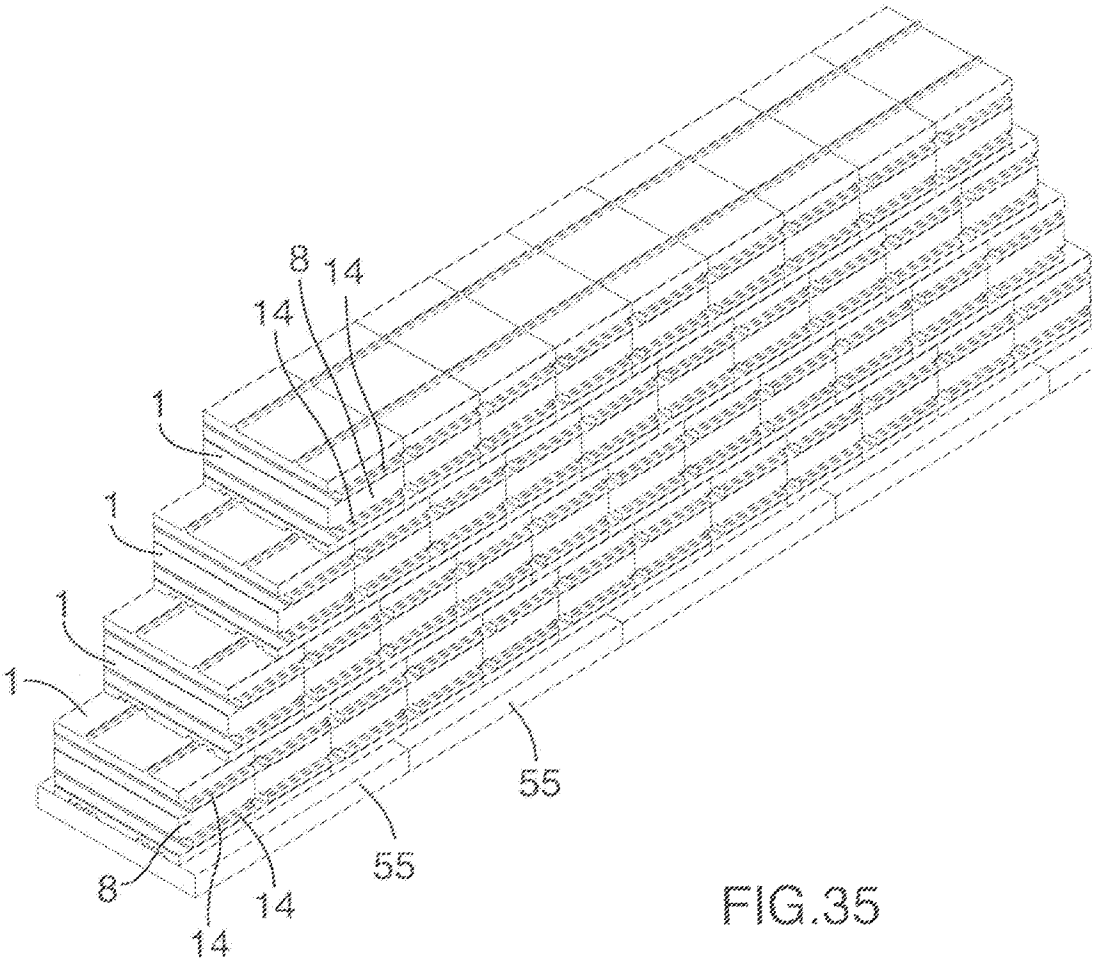
FIGS. 35-40 show views of various examples of wall assemblies that are made from the corner core blocks, alternative mid-course core blocks and face blocks, namely.

FIGS. 35-39 show constructions of walls, without corner assemblies, using the core blocks 1 and not using the connectors 3. Face blocks 24, 40, 44, 47 can be mounted to the mounting ridges 14 on the left side surface 8 and/or right side surface 9 when the core blocks 1 are oriented accordingly as shown in FIG. 35. When a thicker and heavier wall is desired, such as a gravity earth retaining wall, the core blocks can be oriented with mounting ridges 14 and left side surface 8 and/or right side surface 9 facing outward.

Figure 36:
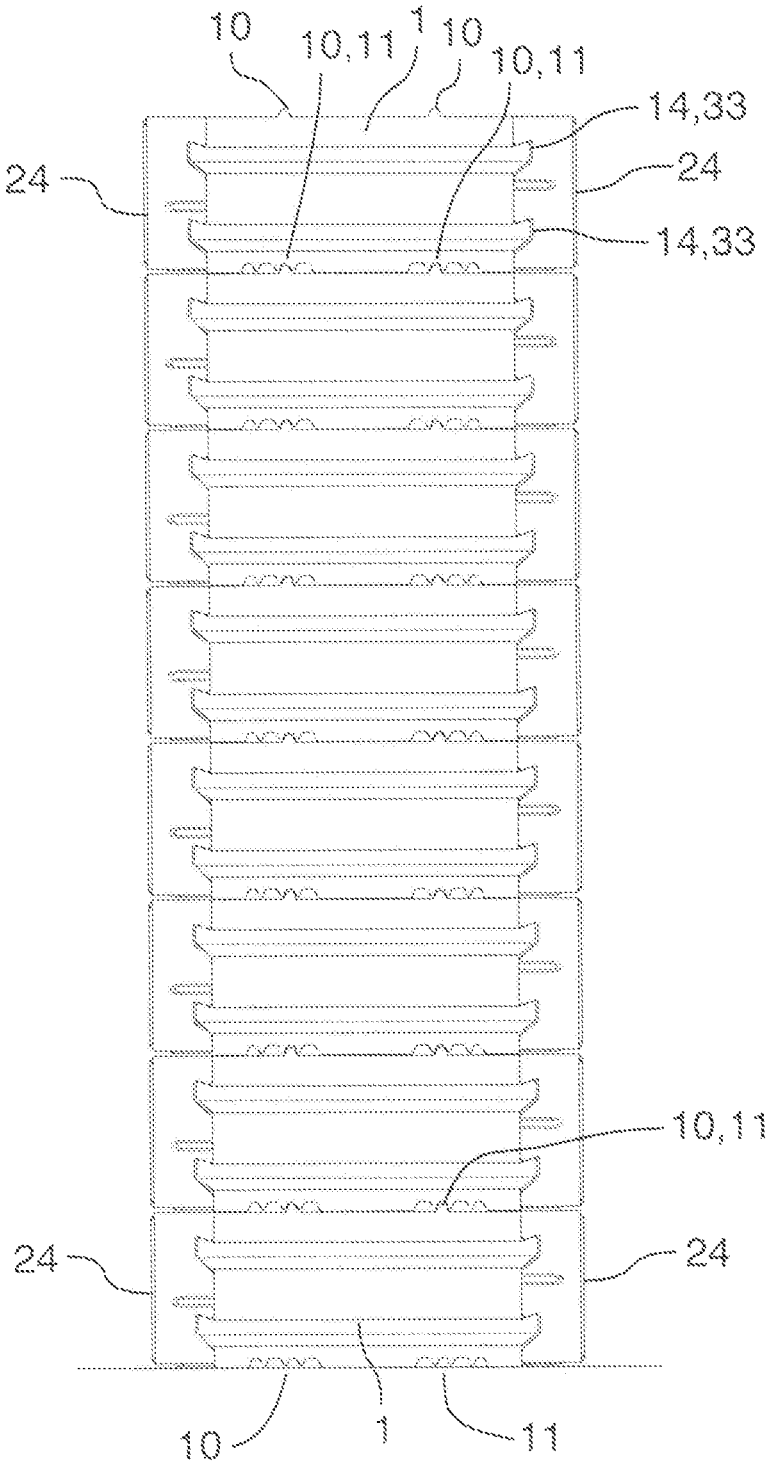
Figure 37:
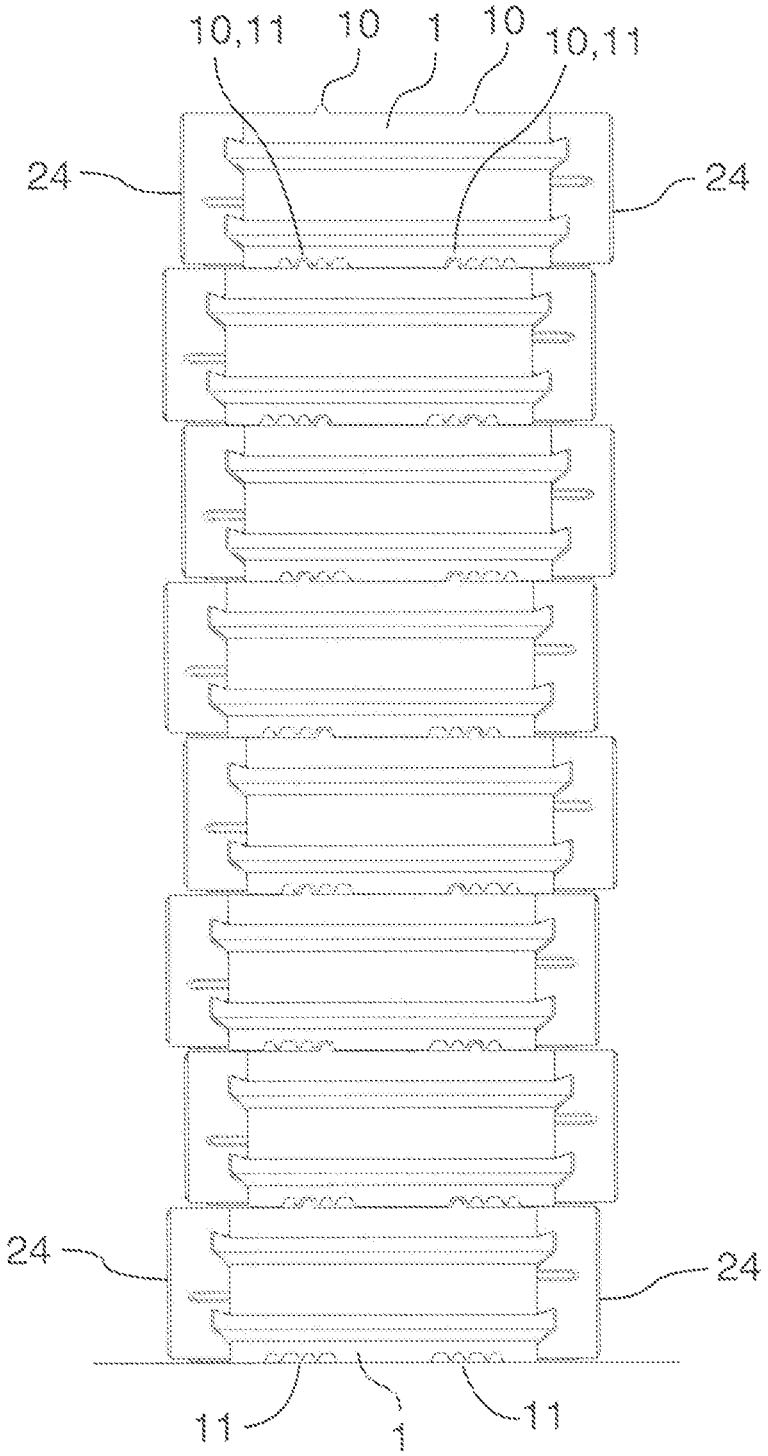

FIG. 36 shows an elevation view of the wall assembly of FIG. 35 with full length face blocks 24 mounted on the horizontal mounting ridges 14 of the core blocks 1. To produce a vertical wall, the alignment protrusions 10 are shown located in the middle of three alignment grooves 11. FIG. 37 shows an elevation view like FIG. 37 but with alternating courses of core blocks 1 and full length face blocks 24 laid in an in/out staggered pattern. The in/out pattern is produced by locating alignment protrusions 10 in the outermost of the three alignment grooves 11 in alternating courses.

Figure 38:
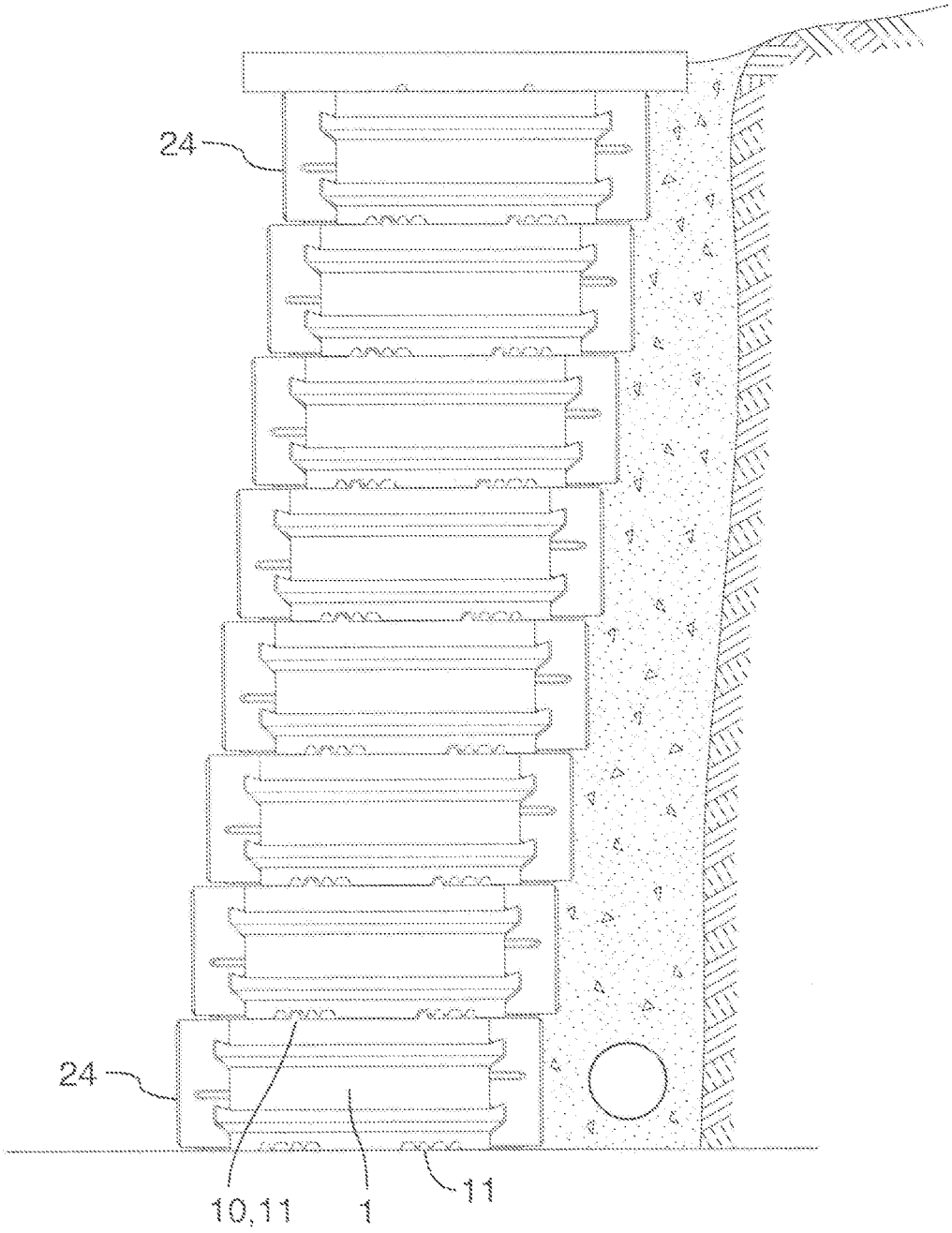
Figure 39:
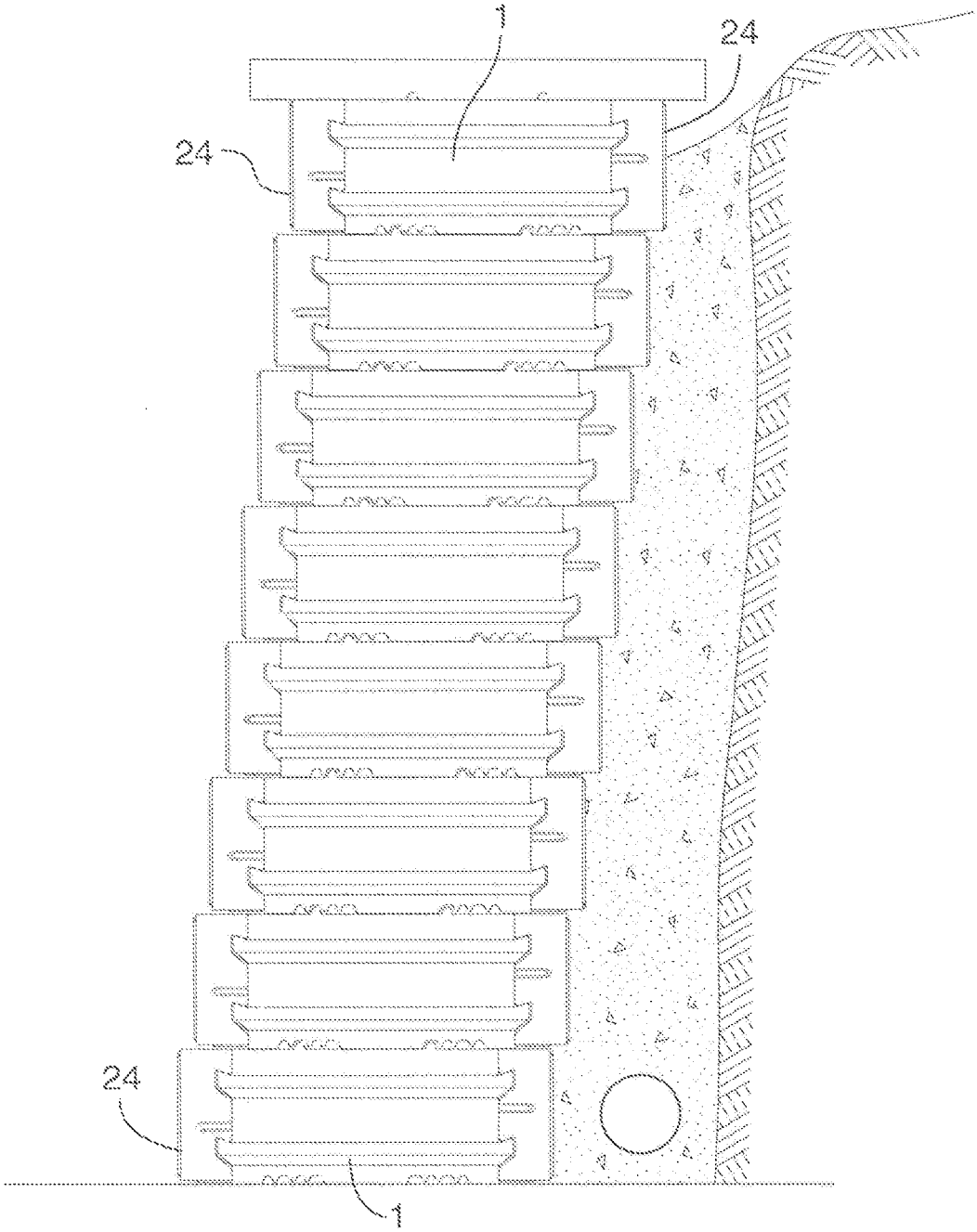

FIG. 38 shows an elevation view of a battered or leaning earth retaining wall. The core blocks 1 and full length face blocks 24 are laid in a leaning or battered pattern with a left exposed side covered with face blocks 24, for decorative effect for example. FIG. 39 shows a similar battered wall assembly but with face blocks 24 mounted on both sides of the core blocks 1. The face blocks 24 on the left would be exposed and decorative. The majority of face blocks 24 to the right could be low cost without particular visual appeal, used for increasing the weight of the wall, and for reinforcing the wall structure since the face blocks 24 span across joints between the core blocks 1. The face block 24 at the top of the wall is visible and exposed since the soil or turf is below the top edge of the wall. In such situations, a decorative or visually appealing face block 24 along the top rear edge of the wall presents a finished decorative edge as shown in FIG. 39.

Figure 40:
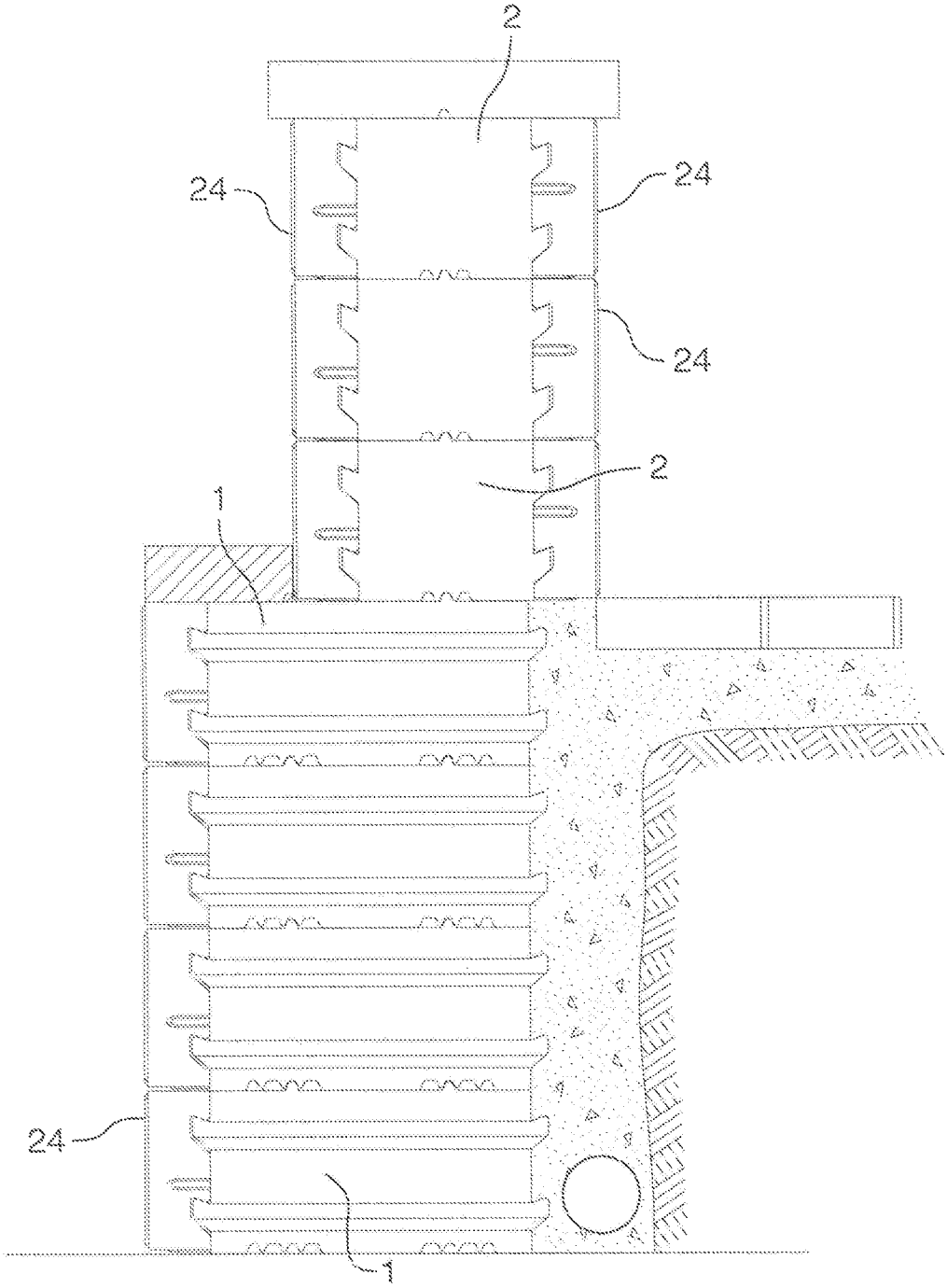
Figure 41:
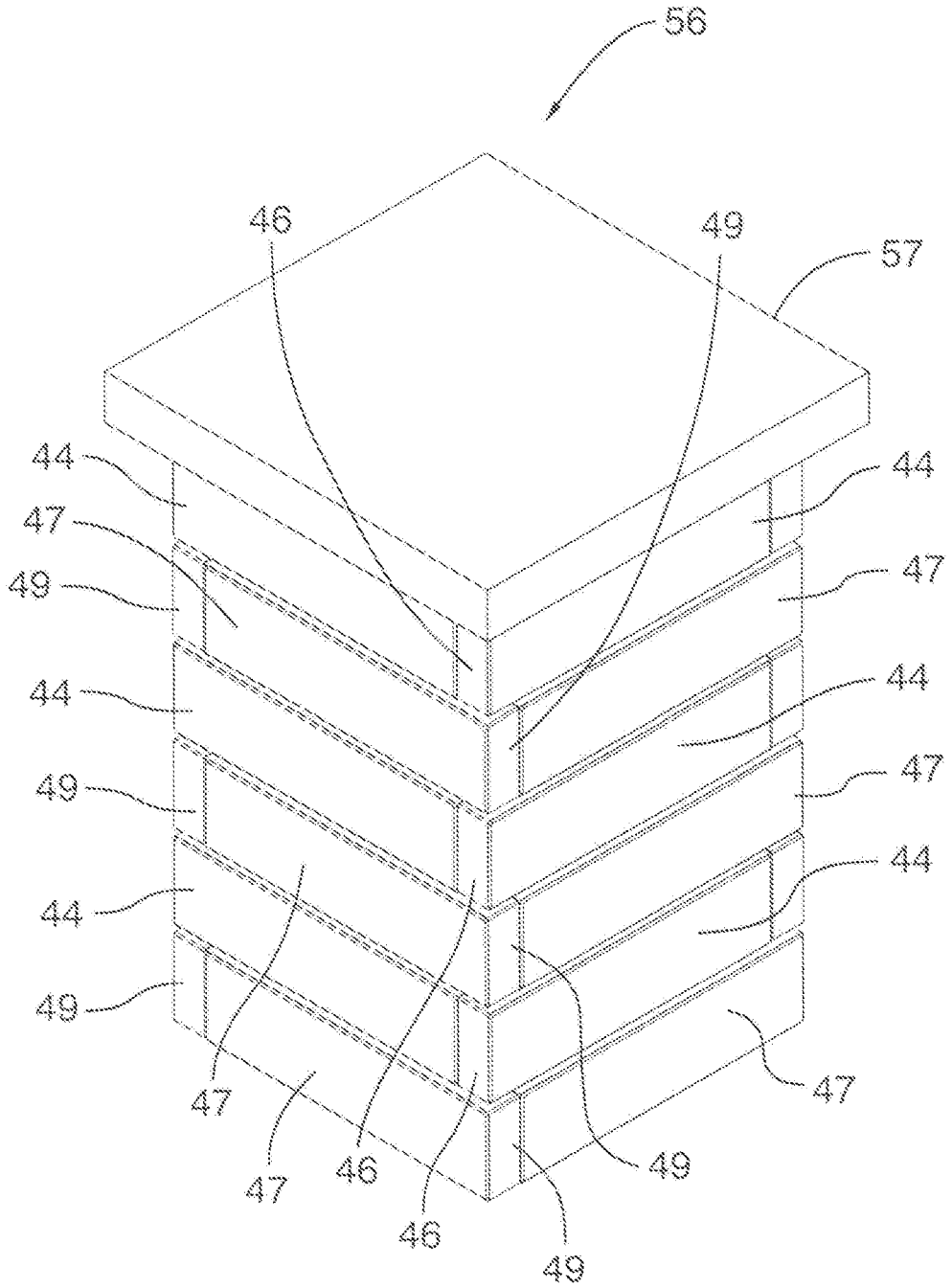
FIGS. 41-48 show views of a pillar assembly made from the corner core blocks, connectors and face blocks, namely.

FIG. 40 shows an elevation view of a lower wall with face blocks 24 on a left side made of four courses of core blocks 1 and an upper seat wall made of the alternative mid-course core blocks 2 (see FIG. 15) with face blocks 24 on both left and right sides. This arrangement could be used for a terraced platform with a protective edge wall for example.

FIGS. 41-48 show views of a pillar assembly 56 which effectively has four corners made as described above. The pillar assembly 56 illustrated is constructed with a cap slab 57, corner core blocks 1, connectors 3, closed right end face blocks 44, and closed left end face blocks 47 however any size or shape of pillar can be constructed using the standardized components described above.

Figure 42:
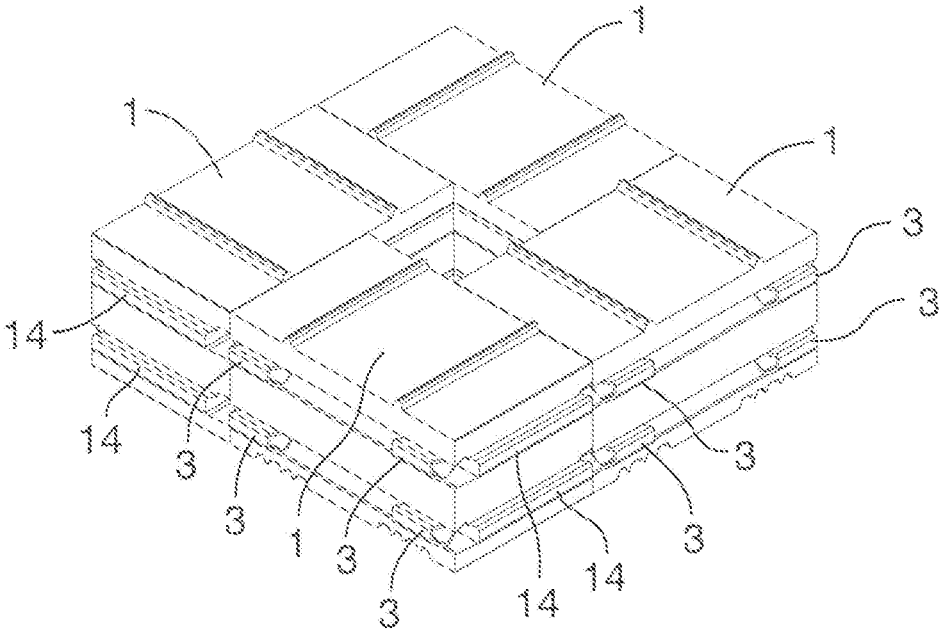
Figure 43:
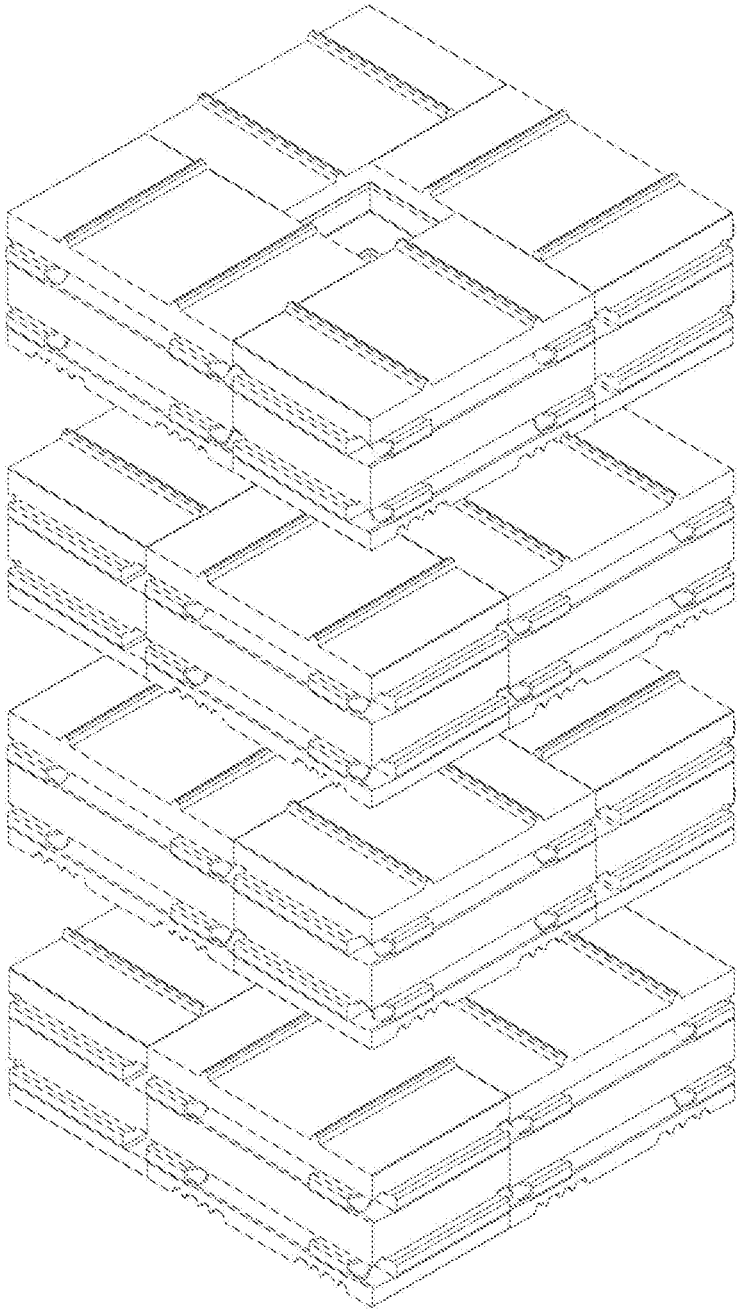
Figure 44:
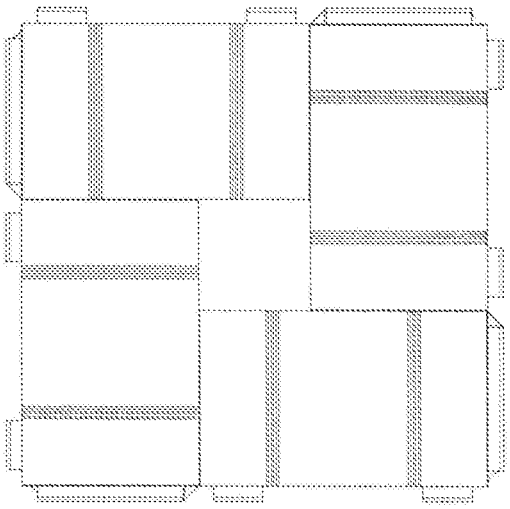
Figure 45:
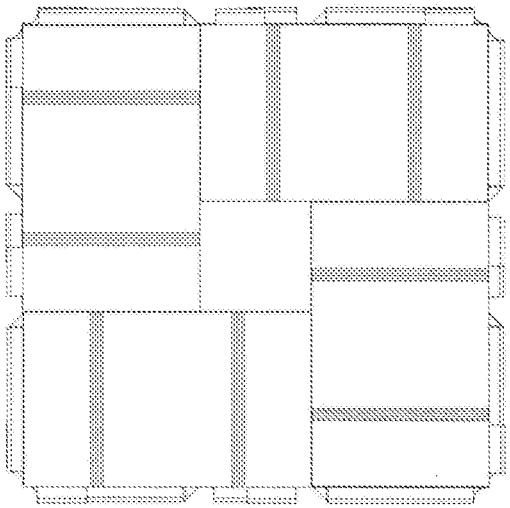

To start the pillar assembly, a foundation slab is poured or placed from pre-cast slabs. FIG. 42 shows an isometric view of a first course of corner core blocks 1 for the pillar assembly 56 of FIG. 41. Connectors 3 are mounted in the horizontal mounting recesses 12 of each core block 1. Horizontal mounting ridges 14 also face outward for mounting face blocks 44, 47 thereon. FIG. 43 shows four alternating stacked courses to form the core of the pillar assembly. For example, FIG. 44 shows a plan view of the first course in FIG. 42 and the third course of the core of the pillar assembly 56 in FIG. 43. FIG. 45 shows a plan view of the second and fourth courses of the core of the pillar assembly 56 in FIG. 43.

Figure 46:
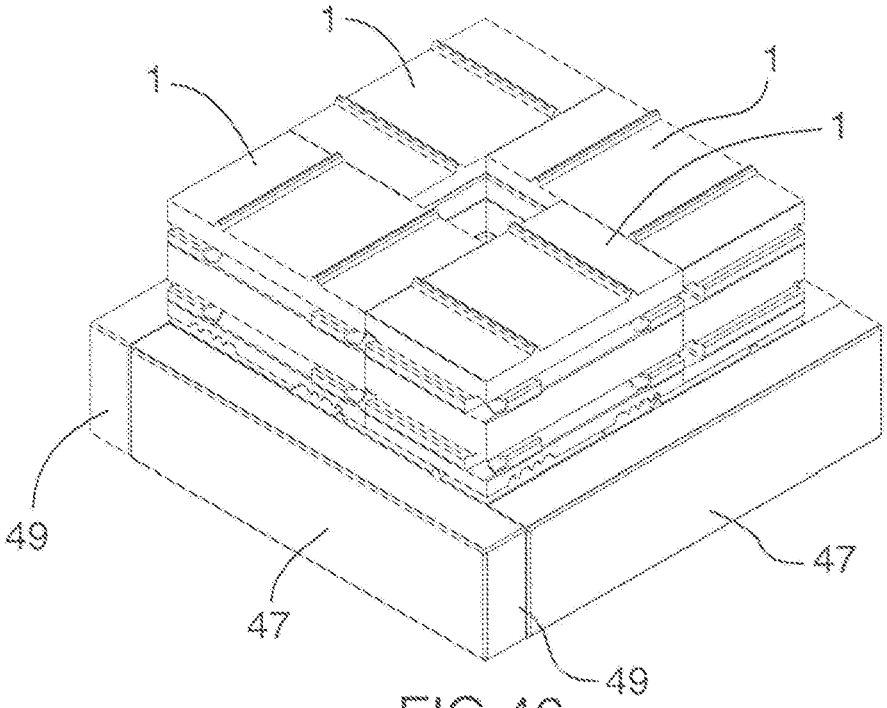
Figure 47:
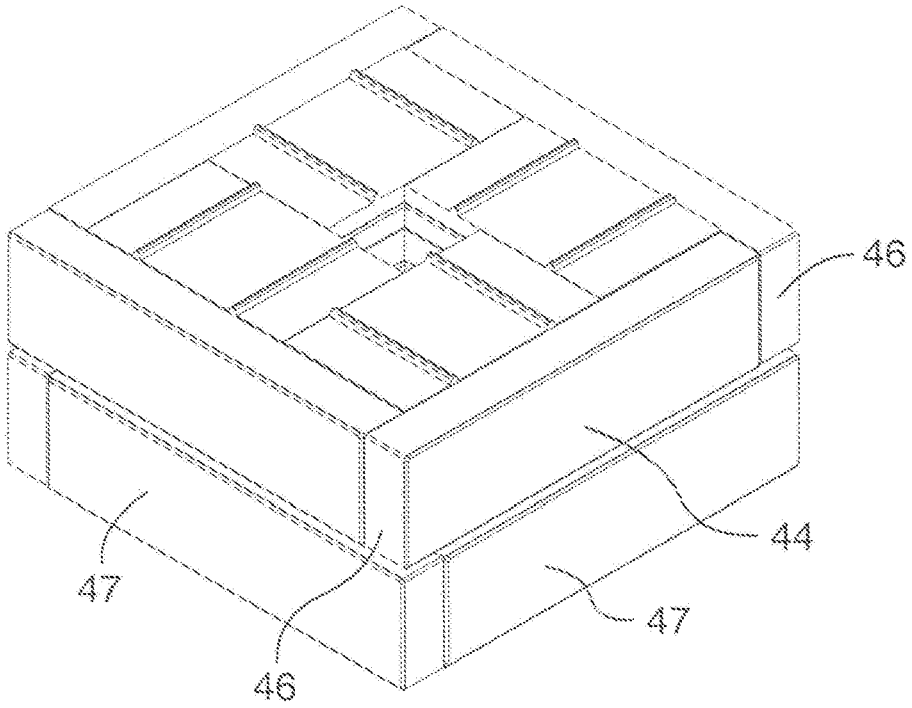
Figure 48:
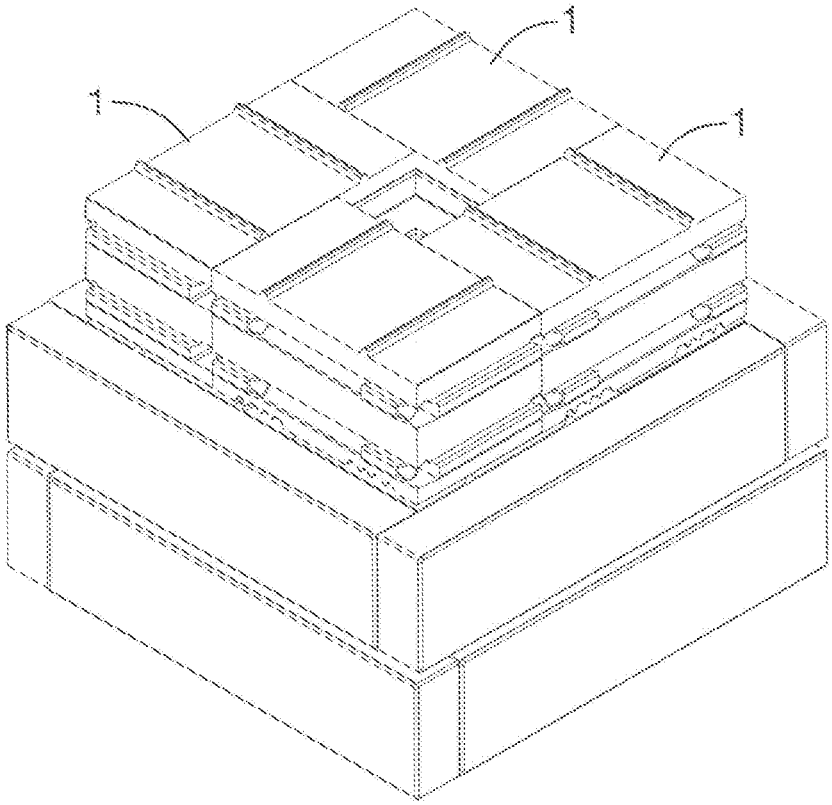
Figure 49:
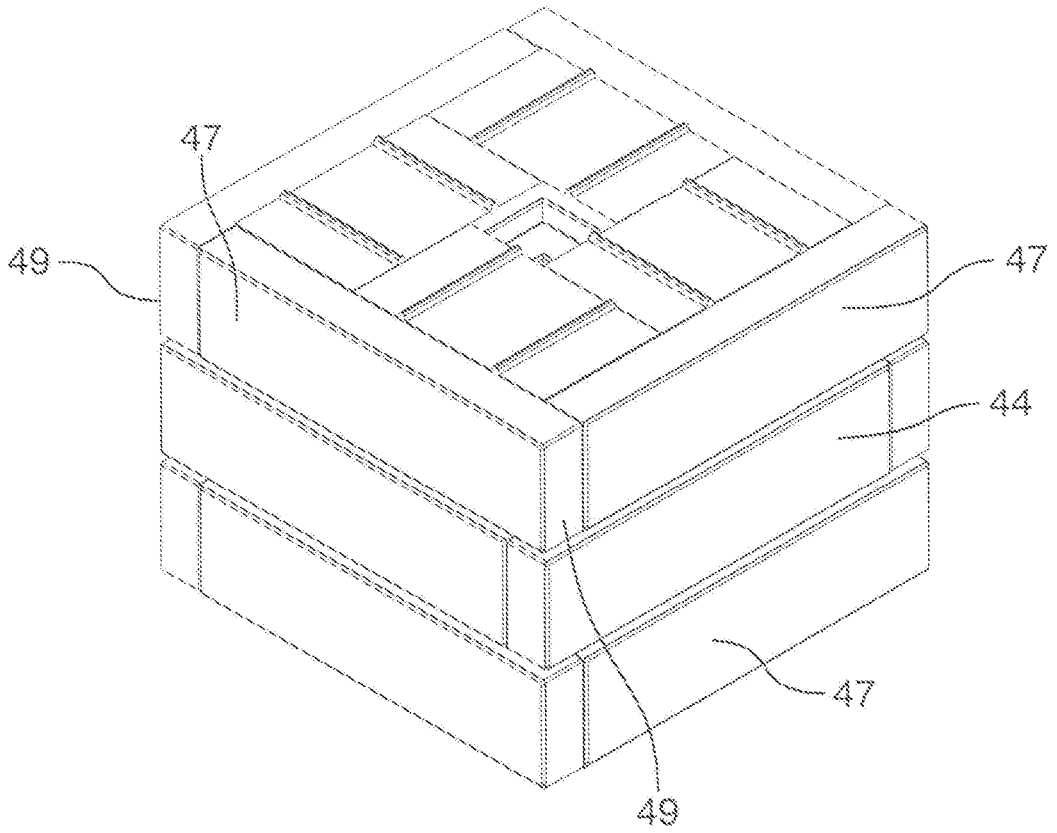
FIG. 49 shows the three courses of FIG. 48 with face blocks on both the first, second and third courses.

FIG. 46 shows the first and second courses of the core blocks 1 of the pillar assembly with closed left end face blocks 47 installed on the first course. FIG. 47 shows the first and second courses like FIG. 46 with closed right end face blocks 44 on the second course. FIG. 48 shows the third course of corner core blocks 1 laid thereon. FIG. 49 shows three courses with alternating courses of face blocks 47, 44, 47.

FIGS. 50-51 show construction of a stair assembly made from the corner core blocks 1 laid in corner arrangements as described above, with connectors 3 and mounting ridges 14 used to mount the required face blocks. FIG. 50 shows four levels of stairs constructed of core blocks 1 laid at right angles to each other similar to FIGS. 7-9 described above. Referring to FIG. 51, full length face blocks 24 and closed left end face blocks 47 are used as visible and decorative risers and to cover exposed side walls. Stair tread blocks 58 serve as horizontal stair treads. The stair assembly can be secured together with compatible adhesives if desired.

Figure 52:
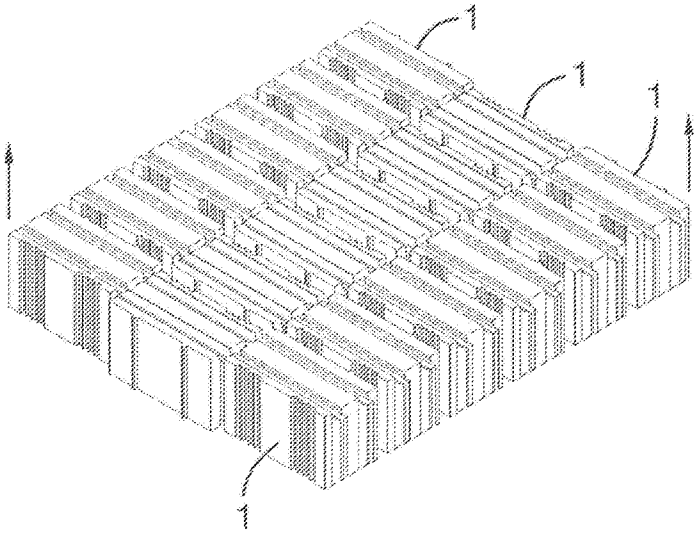
FIG. 52 shows an assembly of core blocks as molded together with the slip mold removed in the direction indicated with arrows.

FIG. 52 shows the molding arrangement of multiple core blocks 1 as molded together on a flat pallet or surface with a slip mold removed in the direction indicated with arrows. To form the slots 13 in the top surface, a press plate includes molding ridges of the same shape so that when the low slump mix is poured into the mold and pressed with the press plate, the resulting core block 1 retains the shape of the molding ridges as slots 13. The low slump concrete mix does not deform or slump significantly and the shape of the slots 13 remain. To form the undercut shape of the front mounting recesses 12, a mold insert 59 having the same shape is placed in the bottom of the molds before the low slump concrete mix is poured into the molds. After the press plate and slip molds are removed, the inserts 59 are removed by sliding laterally out of the formed front mounting recesses 12.

Although the above description relates to a specific preferred embodiment as presently contemplated by the inventors, it will be understood that the invention in its broad aspect includes mechanical and functional equivalents of the elements described herein.

We claim:

1. A construction system comprising:

a plurality of core blocks, each core block having: a front surface; a rear surface; a top surface; a bottom surface; a left side surface; and a right side surface, the top and bottom surfaces adapted for engaging the core blocks together in stacked courses with adjacent side surfaces, each core block having a horizontal front mounting recess in the front surface with a uniform cross-sectional profile having a front opening, an upper core pocket extending rearward and upward from a top edge of the front opening defining a core detent lip, and a core base extending rearwardly from a bottom edge of the front opening to the upper core pocket;

a plurality of face blocks, each face block having: an exposed front surface; a rear surface; a top surface; a bottom surface; a left side surface; and a right side surface, the rear surface of each face block having a horizontal rear mounting recess with a uniform cross-sectional profile having a rear opening, an upper face pocket extending rearward and upward from a top edge of the rear opening defining a face detent lip, and a face base extending rearwardly from a bottom edge of the rear opening to the upper face pocket, and wherein each face block has a center of gravity located at an eccentric distance from the rear surface;

a plurality of connectors for supporting stacked courses of the face blocks suspended on the front surfaces of the stacked courses of core blocks, the connectors having a rear hook and a front hook;

wherein the face blocks are each supported by their rear surfaces with at least one connector, by engagement of the front hook with the face detent lip and engagement of the rear hook with the core detent lip; and wherein the horizontal rear mounting recess of a corner face block has a closed end adjacent to one of: the left side surface; and the right side surface.

2. The construction system according to claim 1, wherein the connector includes a bottom surface engaging the core base of the front mounting recess.

3. The construction system according to claim 2 wherein the bottom surface of the connector is convex and the core base is concave.

4. The construction system according to claim 1 wherein the connector has a uniform cross-sectional profile.

5. The construction system according to claim 4 wherein the connector is a hollow tube.

6. The construction system according to claim 4 wherein the connector is extruded from one of: plastic; rubber and aluminum.

7. The construction system according to claim 1 wherein one of: the left side surface; and the right side surface, of the core block includes a horizontal mounting ridge for supporting the face block by the rear surfaces by engagement of the horizontal mounting ridge with the face detent lip.

8. The construction system according to claim 7 wherein the rear surface of the core blocks includes a slot for receiving the horizontal mounting ridge of an adjacent core block.

9. The construction system according to claim 1 wherein the horizontal rear mounting recess of the face block extends from the left side surface to the right side surface.

10. The construction system according to claim 1 wherein each core block has protrusions and grooves in one of the top and bottom surfaces for interlocking the core blocks together in stacked courses.

* * * * *